US010746501B2

(12) United States Patent
Springer

(10) Patent No.: US 10,746,501 B2
(45) Date of Patent: Aug. 18, 2020

(54) ARCHERY RELEASE DEVICE AND METHOD

(71) Applicant: Copper John Corporation, Auburn, NY (US)

(72) Inventor: Eric C. Springer, Auburn, NY (US)

(73) Assignee: Copper John Corporation, Auburn, NY (US)

( * ) Notice: Subject to any disclaimer, the term of this patent is extended or adjusted under 35 U.S.C. 154(b) by 0 days.

(21) Appl. No.: 16/384,194

(22) Filed: Apr. 15, 2019

(65) Prior Publication Data

US 2019/0316867 A1 Oct. 17, 2019

Related U.S. Application Data

(60) Provisional application No. 62/658,016, filed on Apr. 16, 2018.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 228,302 A 6/1880 Beard
229,089 A 6/1880 Burnham
4,009,703 A * 3/1977 Cunningham, Sr. ..... F41B 5/1469 124/35.2
4,036,204 A 7/1977 Scott
4,160,437 A 7/1979 Fletcher
4,316,443 A * 2/1982 Giacomo ..... F41B 5/1469 124/35.2
4,567,875 A 2/1986 Fletcher
4,574,767 A 3/1986 Gazzara
4,620,523 A 11/1986 Peck
4,674,469 A 6/1987 Peck
4,881,516 A 11/1989 Peck
5,170,771 A * 12/1992 Peck ..... F41B 5/1469 124/35.2
5,205,268 A 4/1993 Savage
5,448,983 A 9/1995 Scott
5,595,167 A 1/1997 Scott
5,596,977 A 1/1997 Scott
5,765,536 A 6/1998 Scott
5,803,068 A 9/1998 Summers
5,850,825 A 12/1998 Scott
6,032,661 A 3/2000 Goff et al.
6,584,966 B1 7/2003 Summers et al.
(Continued)

*Primary Examiner* — John A Ricci
(74) *Attorney, Agent, or Firm* — Barclay Damon LLP

(57) ABSTRACT

An archery release device and method are disclosed herein. The archery release device, in an embodiment, includes a trigger, a leverage link and a cord holder. In the hold arrangement, the trigger, the leverage link and the cord holder are coupled together through a direct connection or an indirect connection. The coupling, direct or indirect, causes the cord holder to hold a draw cord when the cord holder is subject to a pulling force. In the release arrangement, a release interface of the leverage link is decoupled from the trigger, and another release interface of the leverage link is decoupled from the cord holder.

20 Claims, 21 Drawing Sheets

(56) References Cited

U.S. PATENT DOCUMENTS

| | | | |
|---|---|---|---|
| 6,736,124 | B2 | 5/2004 | Carter |
| 6,925,995 | B1 | 8/2005 | McConnell et al. |
| 7,278,415 | B2 | 10/2007 | Jones |
| 7,926,475 | B2 | 4/2011 | Jones |
| 7,946,282 | B2 | 5/2011 | Jones |
| 8,146,578 | B2 | 4/2012 | Jones |
| 8,276,575 | B1 | 10/2012 | Gillig |
| D688,346 | S | 8/2013 | Jones |
| D697,575 | S | 1/2014 | Jones |
| D697,992 | S | 1/2014 | Jones |
| 8,746,222 | B2 | 6/2014 | Jones |
| 8,746,223 | B2 | 6/2014 | Jones |
| 8,869,781 | B2 | 10/2014 | Jones |
| 9,163,897 | B1 | 10/2015 | Estridge et al. |
| 9,857,139 | B2 | 1/2018 | Kelly et al. |
| 9,863,736 | B2 | 1/2018 | Kelly et al. |
| 9,891,019 | B2 | 2/2018 | Haas et al. |
| 2003/0230295 | A1 | 12/2003 | Jones |
| 2010/0108047 | A1 | 5/2010 | Jones |
| 2011/0168146 | A1 | 7/2011 | Deceuster |
| 2013/0174821 | A1 | 7/2013 | Jones |
| 2016/0025445 | A1 | 1/2016 | Kelly et al. |
| 2017/0176129 | A1 | 6/2017 | Haas et al. |
| 2018/0187998 | A1* | 7/2018 | Haas ..... F41B 5/1469 |

* cited by examiner

ARCHERY RELEASE DEVICE AND METHOD

CROSS-REFERENCE TO RELATED APPLICATION

This application is a non-provisional of, and claims the benefit and priority of, U.S. Provisional Patent Application No. 62/658,016 filed on Apr. 16, 2018. The entire contents of such application are hereby incorporated herein by reference.

BACKGROUND

Archery release aids are used to hold a bowstring in the drawn position. The known release aids attach to the bowstring and pull the bowstring to the drawn position. The user activates the release aid, either by activating a trigger or by jerking the release, to cause the bowstring to slide off of the release aid's hook, thereby allowing the bowstring to fire an arrow.

There are known release aids that include a trigger, a hook, and one or more linkage components coupled to the trigger and hook. The known release aids have drawbacks and deficiencies with respect to ease of use, release responsiveness, force transmission efficiency, reliability, adjustability and repeatability. For example, archers can find it difficult to quickly activate triggers because the triggers provide too much resistance. Also, with the known release aids, there is too much delay between the user's pulling of the trigger and the hook's releasing of the bowstring. Consequently, archers can encounter misfires, impairment of shooting performance, muscle fatigue and reduced shooting accuracy.

The foregoing background describes some, but not necessarily all, of the problems, disadvantages and shortcomings related to the known archery release aids.

SUMMARY

The archery release device, in an embodiment, includes a support, a trigger moveably coupled to the support, and a leverage link pivotally coupled to the support. The leverage link is configured to pivot about a fulcrum point. The leverage link includes first and second arms. The first arm extends from the fulcrum point, and the first arm extends at least partially along a first arm axis. The first arm includes a first release interface located a lever distance from the fulcrum point. The second arm extends in a direction opposite of the first arm. The second arm extends at least partially along a second arm axis. The second arm includes a second release interface positioned on the second arm axis. The second arm axis is offset from the first arm axis by an offset distance. The archery release device also includes a cord holder pivotally coupled to the support. The cord holder includes a cord engager configured to hold an archery draw cord that is applying a pulling force to the cord engager. The cord holder also includes a third release interface. The leverage link and the cord holder are configured to cooperate with each other, in response to a movement of the trigger, to establish one of a hold arrangement and a release arrangement. In the hold arrangement, the trigger, the leverage link and the cord holder are coupled together either through a direct connection or an indirect connection. This coupling, direct or indirect, causes the cord holder to hold the archery draw cord when the cord holder is subject to the pulling force. In the release arrangement, the first release interface is decoupled from the trigger, and the second release interface is decoupled from the third release interface of the cord holder. This causes the cord holder to release the archery draw cord when the cord holder is subject to the pulling force. The hold arrangement is configured to transition to the release arrangement in response to a trigger force that is applied to the trigger. The lever distance is greater than the offset distance, which causes or contributes to a reduction in the magnitude of the trigger force that is necessary to cause the transition.

In another embodiment, the archery release device includes a support, a trigger moveably coupled to the support, and a leverage link. The leverage link is pivotally coupled to the support. The leverage link is configured to pivot about a fulcrum point. The leverage link includes first and second arms, each of which extends along an axis. The first arm includes a first release interface located a lever distance from the fulcrum point. The second arm includes a second release interface. The axes are offset by an offset distance. The archery release device also includes a cord holder pivotally coupled to the support. The leverage link and the cord holder are configured to cooperate with each other, in response to a movement of the trigger, to establish either a hold arrangement or a release arrangement. In the hold arrangement, the trigger, the leverage link and the cord holder are coupled together either through a direct connection or an indirect connection. This coupling, direct or indirect, causes the cord holder to hold a draw cord when the cord holder is subject to a pulling force. In the release arrangement, the first release interface is decoupled from the trigger, and the second release interface is decoupled from the cord holder.

Another embodiment includes a method for manufacturing an archery release device. The method includes obtaining a support, coupling a trigger to the support so that the trigger is moveable relative to the support, and structuring a leverage link to comprise first and second arms. Each of of the first and second arms extends along an axis. The first arm includes a first release interface located a lever distance from the fulcrum point. The second arm includes a second release interface. The axes are offset by an offset distance. The method also includes coupling the leverage link to the support so that the leverage link is pivotal relative to the support so that the pivoting occurs about a fulcrum point. Also, the method includes coupling a cord holder to the support so that the cord holder is pivotal relative to the support. Furthermore, the method includes arranging the leverage link and the cord holder to cooperate with each other, in response to a movement of the trigger, to establish a hold arrangement or a release arrangement. In the hold arrangement, the trigger, the leverage link and the cord holder are coupled together either through a direct connection or an indirect connection. The coupling, direct or indirect, causes the cord holder to hold a draw cord when the cord holder is subject to a pulling force. In the release arrangement, the first release interface is decoupled from the trigger, and the second release interface is decoupled from the cord holder.

Additional features and advantages of the present disclosure are described in, and will be apparent from, the following Brief Description of the Drawings and Detailed Description.

DETAILED DESCRIPTION

Figure 1:
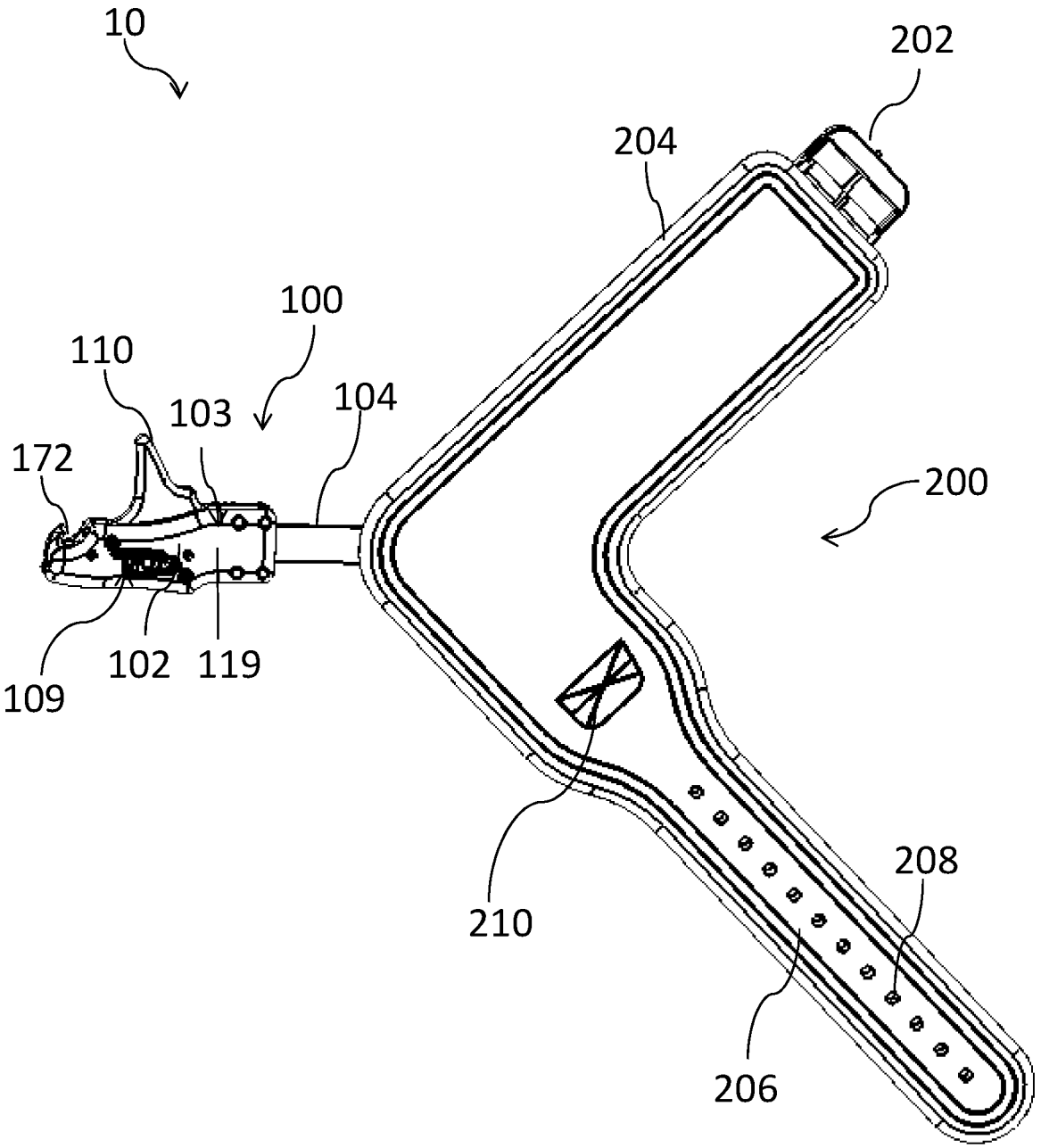
FIG. 1 is a side elevation view of an embodiment of the archery release device, illustrating the wrist coupling assembly in an open, flattened condition.
Figure 2:
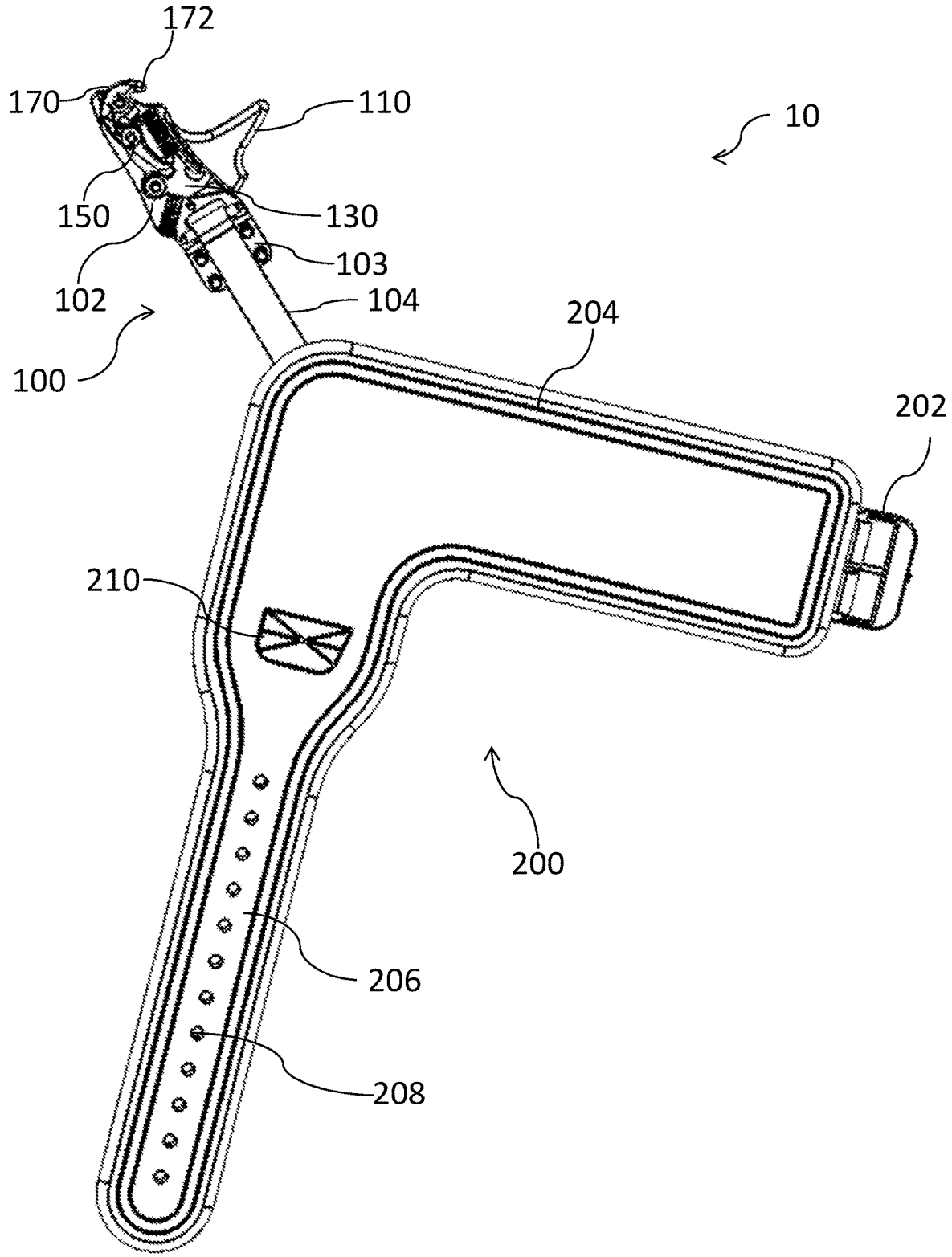
FIG. 2 is another side elevation view of the archery release device of FIG. 1, illustrating the elements visible when the top panel is removed.

As illustrated in the embodiments of FIGS. 1-5, an archery release device 10 includes a release assembly 100 and a wrist coupling assembly 200. As shown, the release assembly 100 generally includes a body or support 102 and a neck or extension 104. As shown, the wrist coupling assembly 200 includes a flexible wrist band 204 configured to wrap around a user's or archer's wrist. The wrist band 204 has an adjustment strap 206 further including or defining a plurality of holes 208. An adjustment strap coupler 202 is positioned on the wrist band 204 and configured to releasably secure a portion of the adjustable strap 206. In an embodiment, a portion of the adjustment strap coupler 202 is configured to occupy at least one of the plurality of holes 208. By securing a portion of the adjustment strap 206 via the adjustment band coupler 202, the wrist coupling assembly 200 assumes a somewhat tubular shape around a central passage (not shown). This central passage is configured to be occupied by an arm or wrist portion of the archer's arm (not shown). The adjustment strap 206 can be released from the adjustment strap coupler 202 and then re-secured to a different portion of the adjustment strap 206 to customize the fit of the wrist coupling assembly 200 to the archer's wrist.

Figure 3:
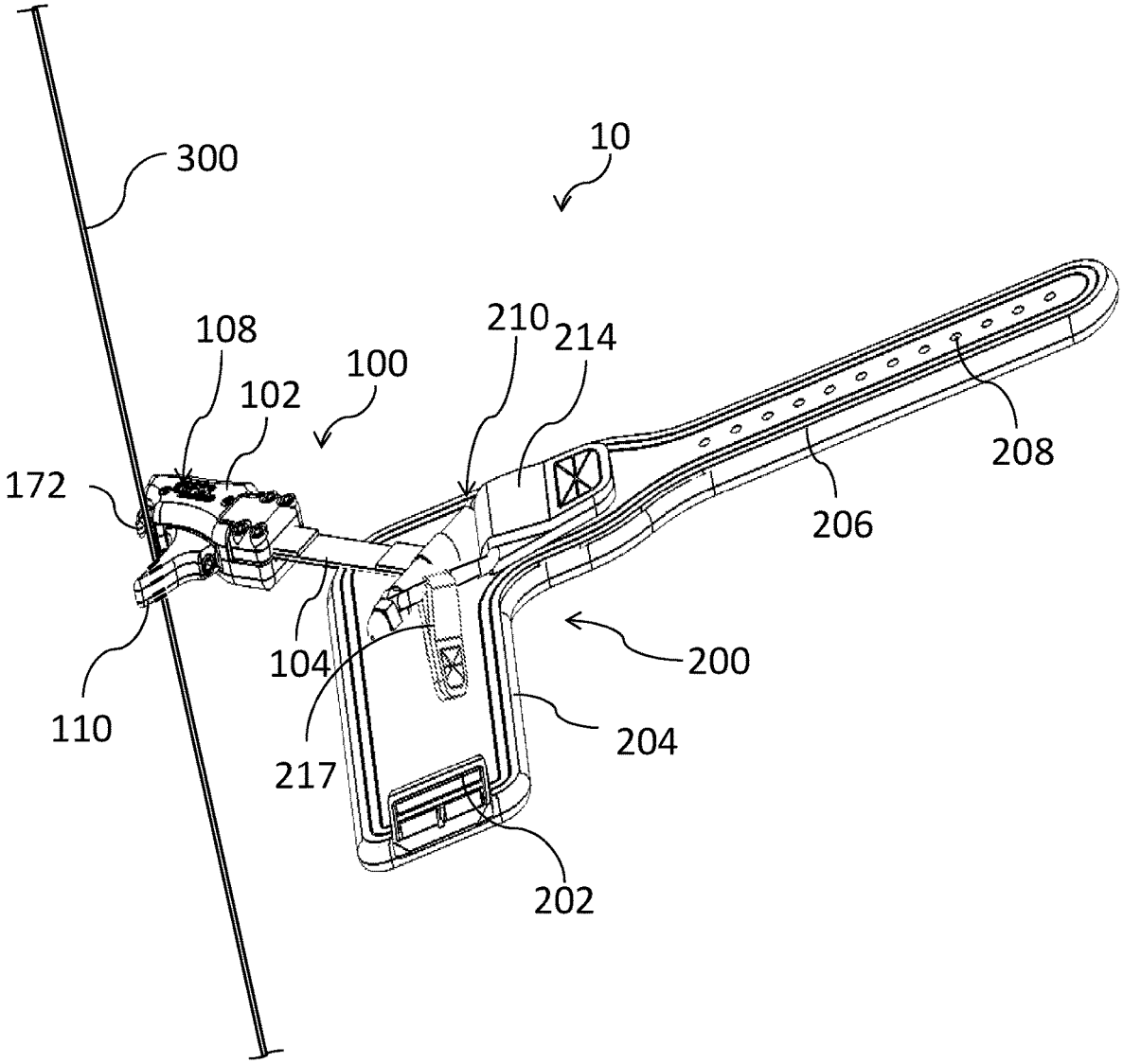
FIG. 3 is an isometric view of the archery release device of FIG. 1, illustrating the archery release device engaged with, and holding, a draw cord.

As shown in FIG. 3, the wrist band 204 also includes a plurality of coupling members 214, 217. As described below, the coupling members 214, 217 may be configured to releasably couple the release assembly 100 to the wrist band 204, or they may be configured for permanent or irreversible coupling.

Figure 4:
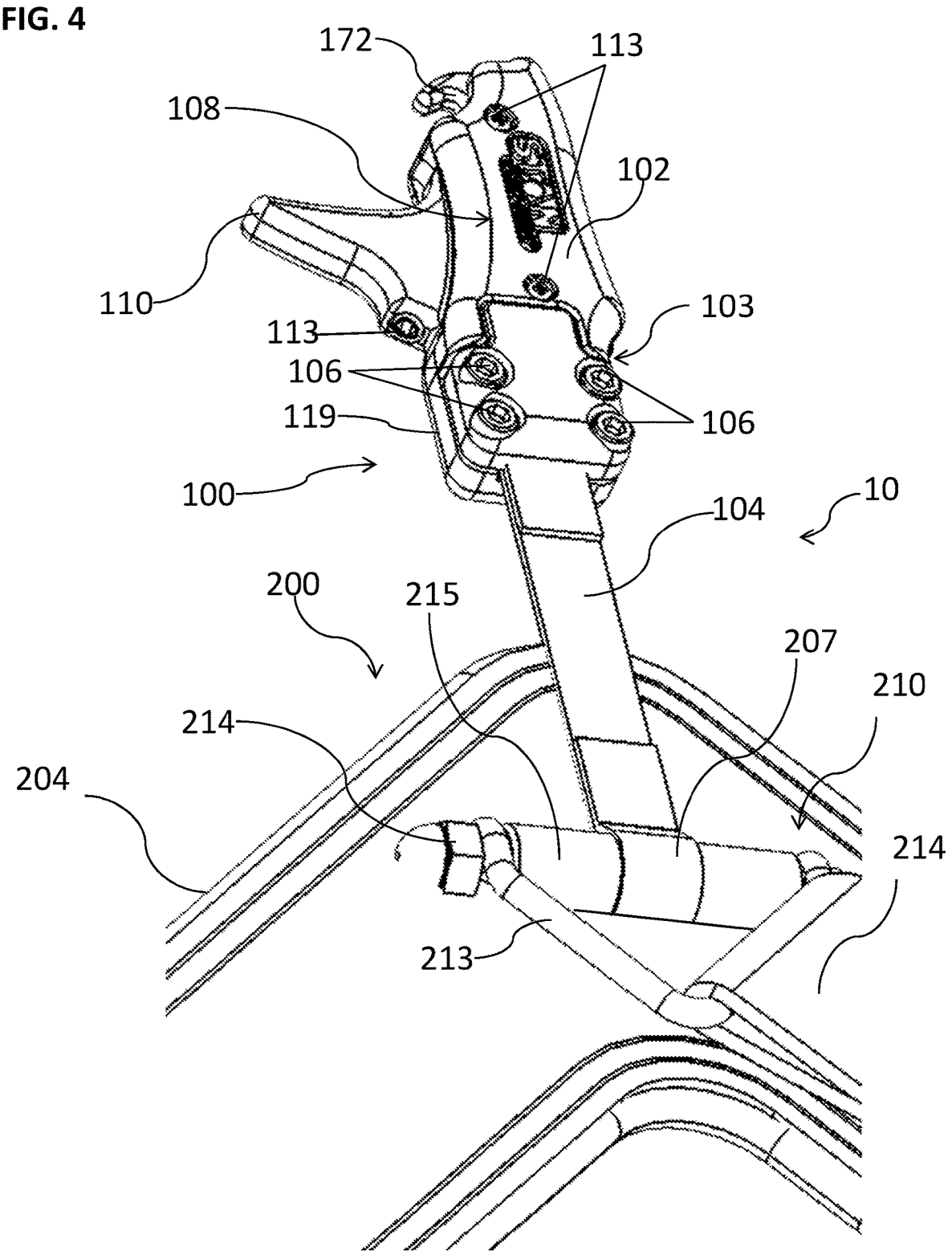
FIG. 4 is an enlarged isometric view of the archery release device of FIG. 1.
Figure 5:
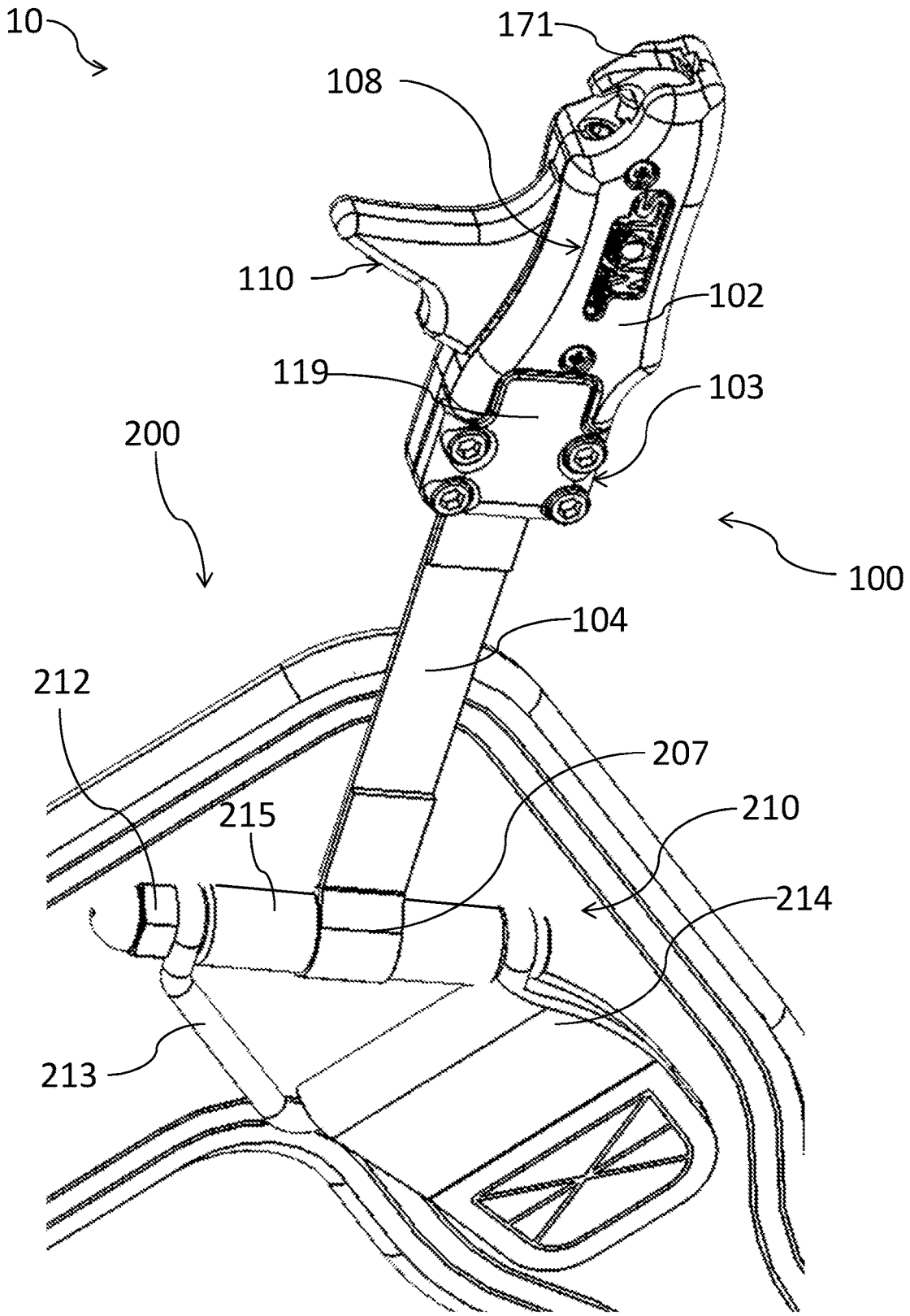
FIG. 5 is another enlarged isometric view of the archery release device of FIG. 1.

As shown in FIGS. 3-5, the wrist coupling assembly 200 further includes a release assembly coupler 210. In an embodiment, the release assembly coupler 210 includes one or more coupling members configured to couple to, and secure, the extension 104 to the wrist band 204. In this embodiment, the extension 104 includes a flexible structure, such as that of a flat strap configured to be flexed and looped onto itself. As shown in FIG. 5, the release assembly coupler 210 includes: (a) a frame 213 which, in the illustrated embodiment, has a V-shape; (b) an axle, shaft or pivot member 215, pivotally coupled to the frame 213, configured to be inserted through a loop 207 defined by the extension 104; and (c) a fastener or coupling member 212, such as a threaded nut, that is attachable to the pivot member 215. In the embodiment shown, each of the coupling members 214, 217 is looped around one of the segments of frame 213. In this way, the coupling members 214, 217 secure the wrist band 204 to the release assembly coupler 210.

Figure 6:
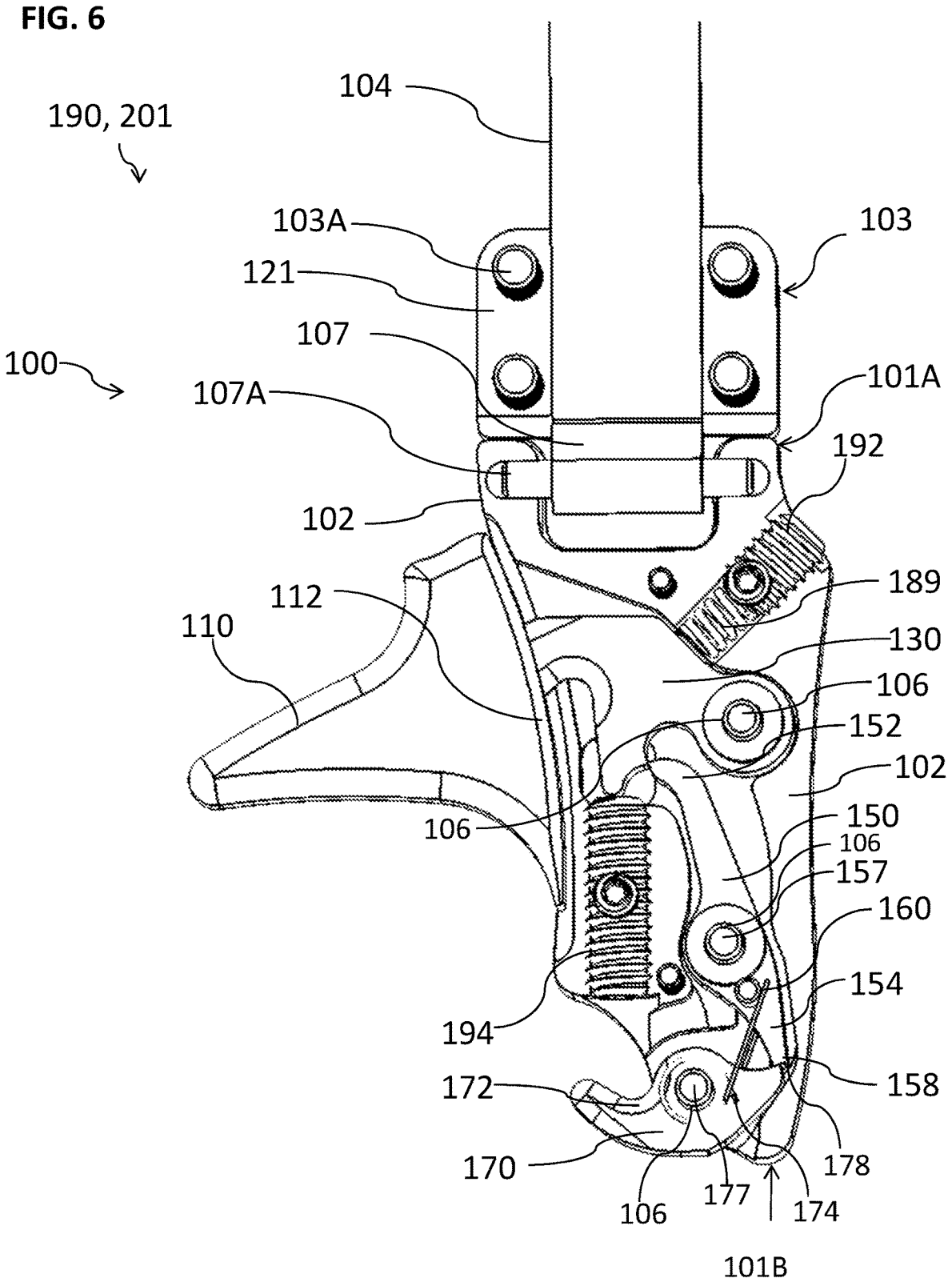
FIG. 6 is an enlarged isometric view of the archery release device of FIG. 1, illustrating the elements visible when the top panel is removed.

With reference to FIGS. 4-6, the release assembly 100 includes the support 102, an extension support 103, and the extension 104. The extension 104 is configured to couple to the wrist coupling assembly 200 at one end and to the extension support 103 at the opposite end. As illustrated in the embodiment of FIG. 6, the extension 104 is coupled to the support 102 using an extension coupler 107A. In this embodiment, the extension 104 defines a loop 107 configured to receive the cylindrical-shaped extension coupler 107A. In an embodiment, the extension coupler 107A may be formed as a single unit with either the extension 104 or the support 102. In another embodiment, the extension coupler 107A may be formed as a separate piece from the extension 104 and the support 102.

The extension support 103 is configured to at least partially house a portion of the extension 104 and the extension coupler 107A. As shown in the embodiments illustrated in FIGS. 1-6, the extension support 103 may be comprised of more than one piece. As shown in FIG. 1, the support 102 may comprise a cap or external panel 119 to enclose the components of the release assembly 100. In an embodiment, the panel 119 may also couple to a portion of the extension support 103. In a further embodiment, the panel 119 may also comprise a portion of the extension support 103. Referring to FIGS. 2 and 6-9, the panel 119 has been removed so that the components of the release assembly 100 may be accessed and/or viewed. In an embodiment, the panel 119 may be permanently coupled to the support 102 such that the components of the release assembly 100 may not be accessed. The external panel 119 may be secured to the extension base 121 (FIG. 6) of the extension support 103 using one or more fasteners, threaded studs, or couplers 103A. In an embodiment, the extension support 103 may be comprised of a central piece that is sandwiched between a top piece and a bottom piece. In another embodiment, at least one of the top and bottom pieces may be coupled directly to the support 102 using one or more couplers 103A.

Figure 7:
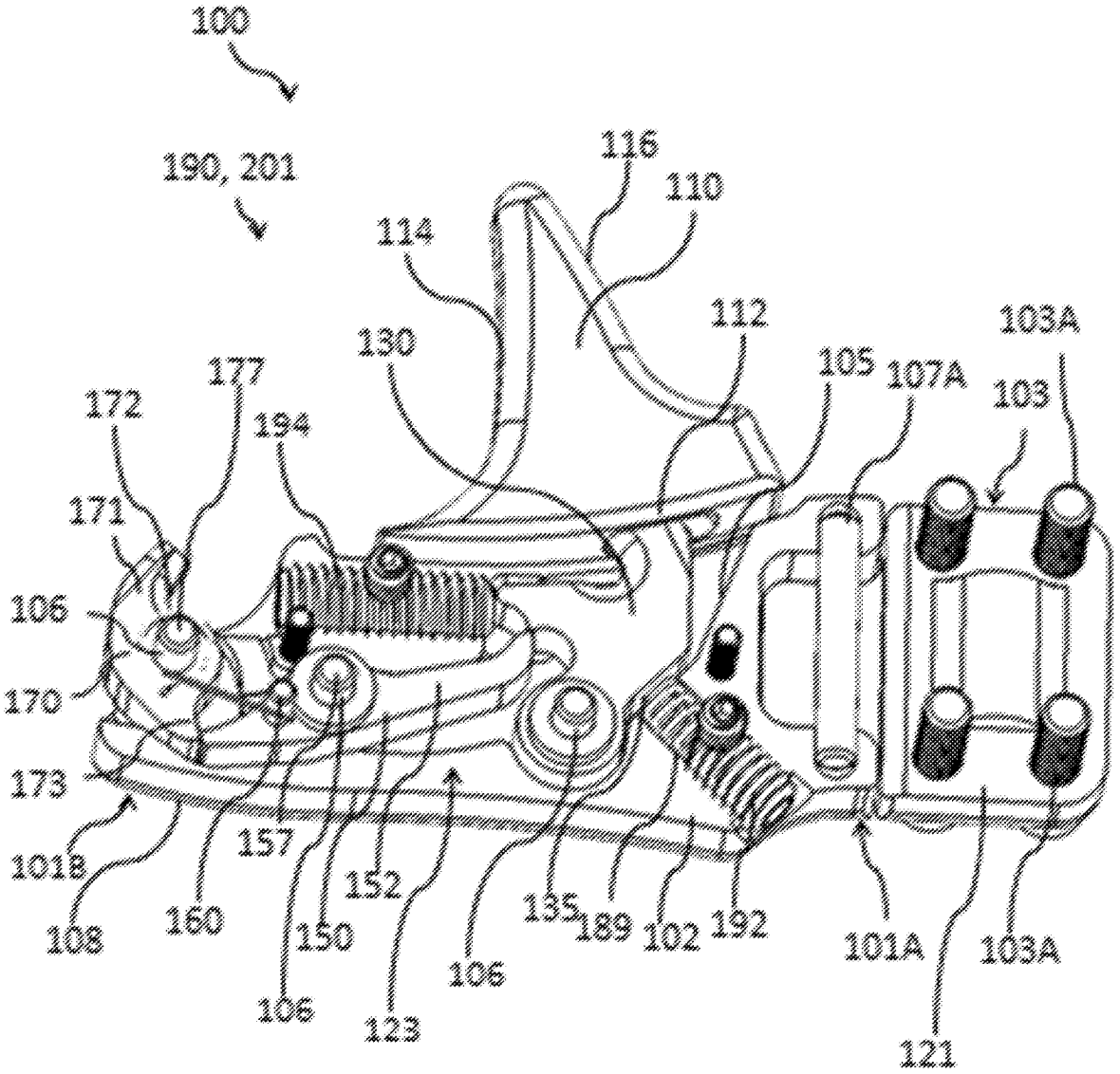
FIG. 7 is another enlarged isometric view of the archery release device of FIG. 1, illustrating the elements visible when the top panel is removed.
Figure 8:
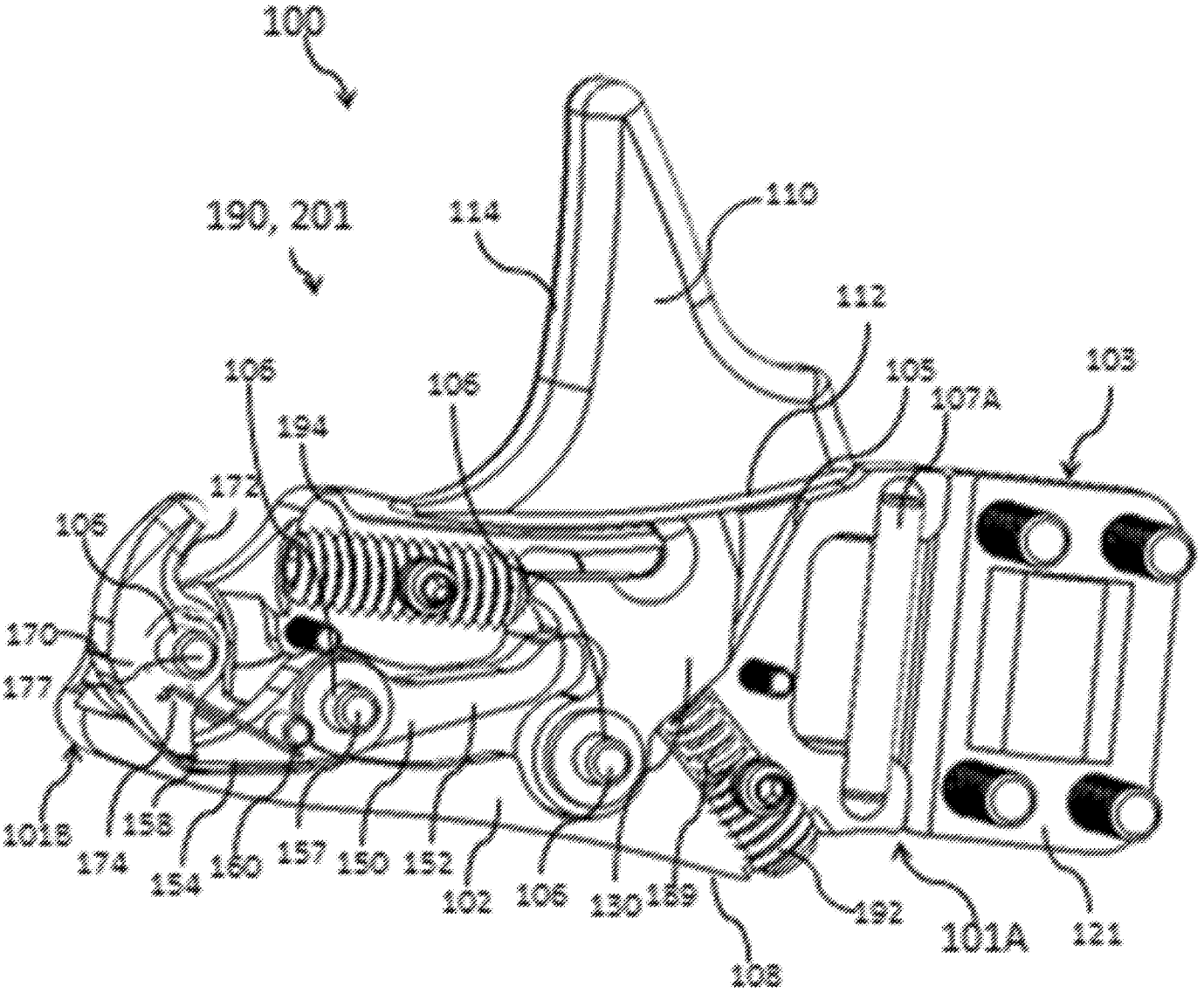
FIG. 8 is yet another enlarged isometric view of the archery release device of FIG. 1, illustrating the elements visible when the top panel is removed.

Referring to FIGS. 6-7, the body or support 102 includes a top 109 (FIG. 1), a bottom 108, a body end 101A configured to attach to the loop 107 of the extension 104, and an opposing body end 101B. The shape and configuration of the support 102 may vary depending on the nature of the release assembly 100 such as the type of release characteristic desired and the number of components required to achieve the desired release characteristic. For example, the support 102 can include a housing or can otherwise define one or more cavities. In the example shown, the top 109, when attached to the bottom 108, forms or defines at least one interior space or cavity 123, shown in FIG. 7. The cavity 123 is configured to receive and encase a plurality of the internal parts of the release assembly 100, including, but not limited to, the leverage link 150 described below.

As shown in FIGS. 6-11B, the release assembly 100 includes: (a) a grasp or trigger 110; (b) a primary link or trigger link 130 coupled to the trigger 110; (c) a sear, secondary link, offset link, multi-arm link or leverage link 150 configured to be interchangeably engaged with the trigger link 130; and (d) a cord holder 170 configured to be interchangeably engaged with the sear or leverage link 150. In an embodiment, the trigger 110, the trigger link 130, the leverage link 150 and the cord holder 170 comprise a release mechanism 190 (FIG. 11A). As shown in FIGS. 6-10, the trigger link 130, the leverage link 150, and the cord holder 170 are each pivotally coupled to the support 102 by one of a plurality of support members 106. The support members 106 used in assembling the archery release device 10 can include any kind of fastener, such as a post, pin, bolt, screw, welded joint, or any other suitable fastener. The use of element number 106 to describe the support members does not necessarily indicate that such support members 106 are, or have to be, of the same type or shape.

Figure 11A:
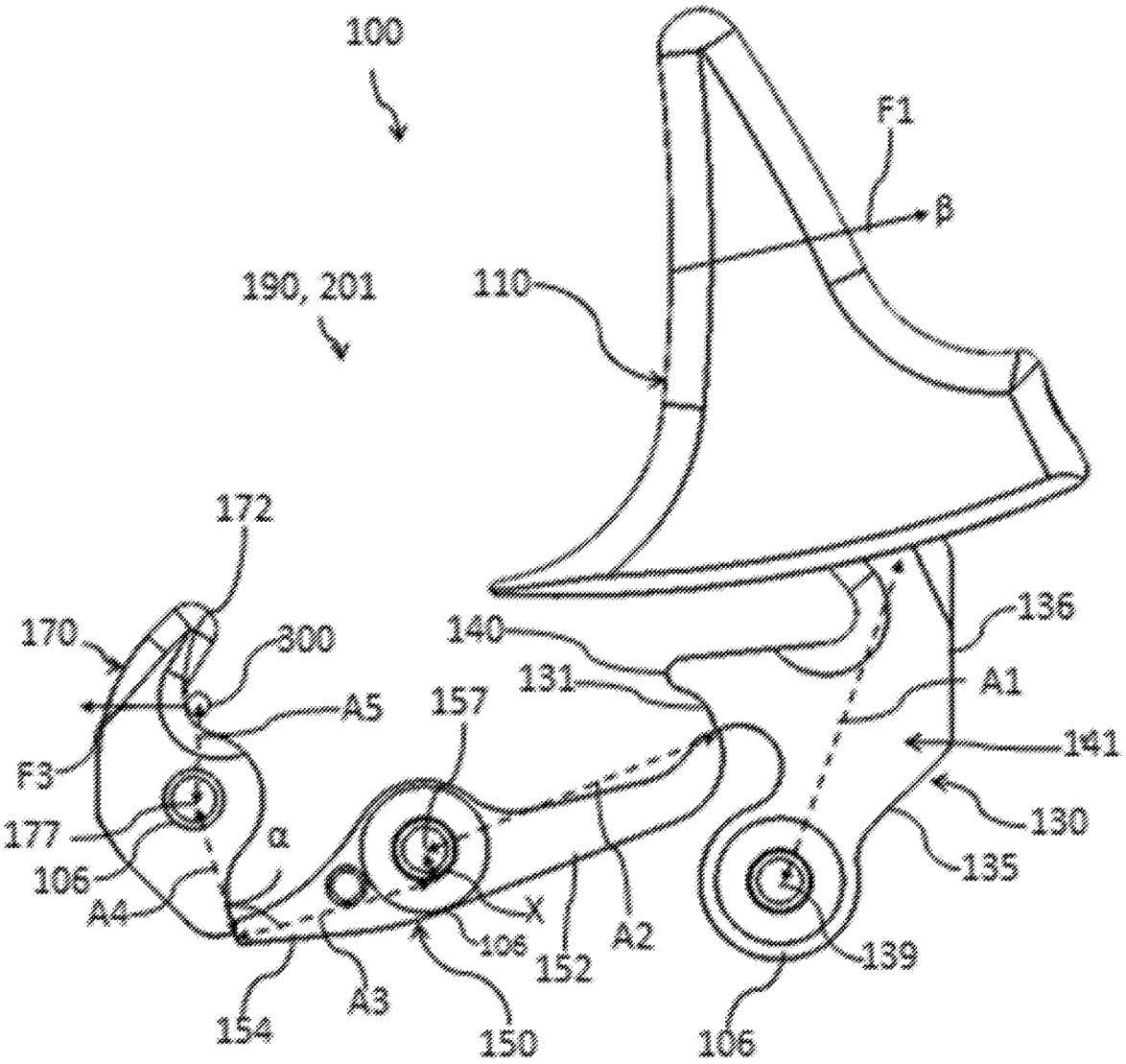
FIG. 11A is an enlarged side elevation view of the archery release device of FIG. 1, illustrating the elements visible when the support and the top panel are removed and further illustrating axes A4, A5, A2, and A1, angle $\alpha$, and offset distance X.
Figure 11B:
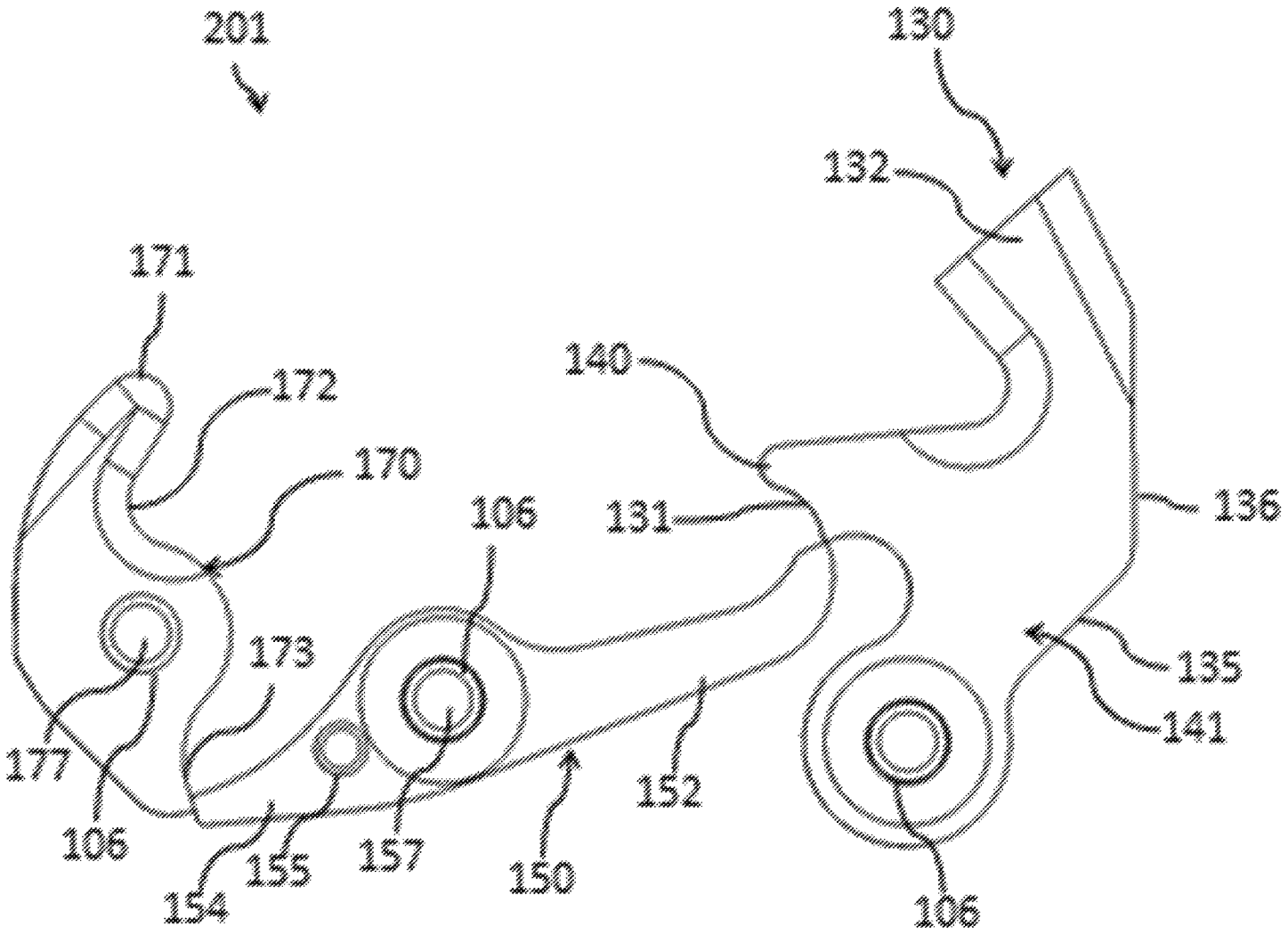
FIG. 11B is an enlarged isometric view of the archery release device of FIG. 1, illustrating the elements visible when the support, trigger and the top panel are removed.
Figure 12A:
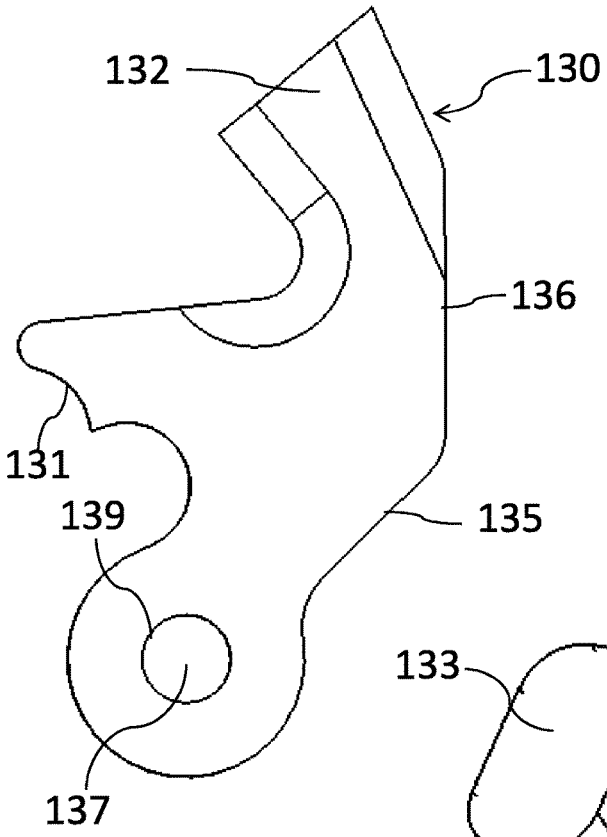
FIG. 12A is an enlarged side elevation view of an embodiment of the trigger link of the archery release device of FIG. 1.
Figure 12B:
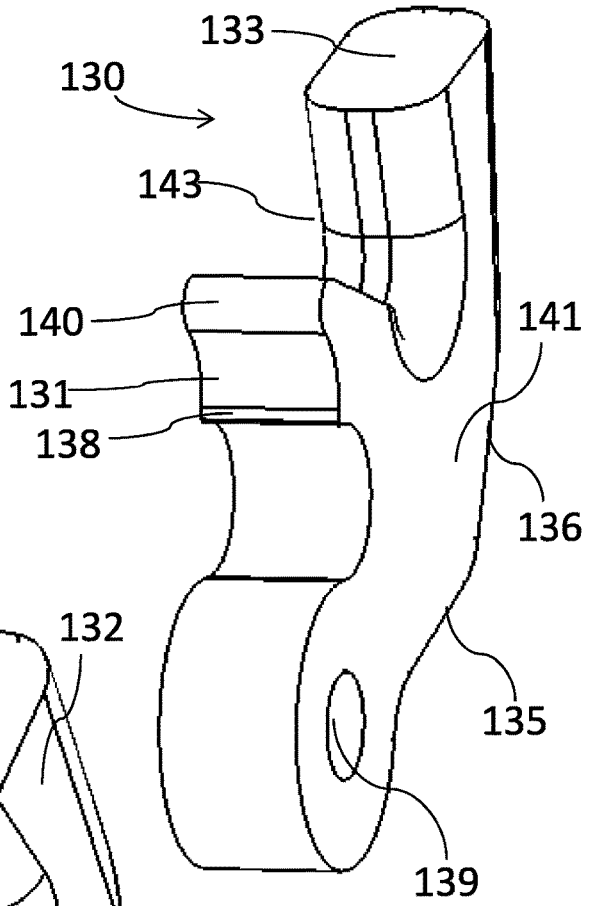
FIG. 12B is an enlarged isometric view of the trigger link of FIG. 12A.
Figure 12C:
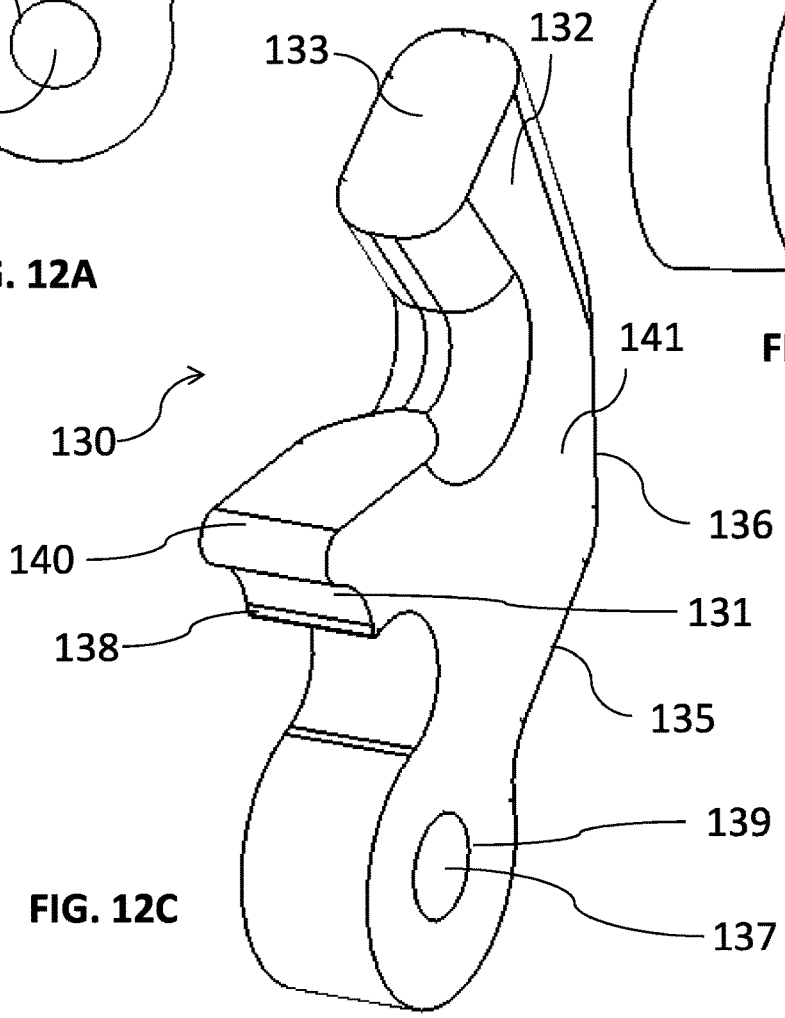
FIG. 12C is another enlarged isometric view of the trigger link of FIG. 12A.

Referring to FIGS. 11A-12C, the trigger link 130 defines a bore 139 that extends from a front surface 141 to a back surface 143, as shown in FIG. 12C. As shown, the bore 139 is positioned at an end that is generally opposite the trigger coupling portion 132. The trigger link 130 further includes a stop side 135, a back side 136, a riding surface 131, a trigger release interface 138, and a link engagement contact surface 140. The trigger link 130 may longitudinally extend along a trigger link axis A1 (FIG. 11), however in an embodiment, the trigger link 130 may have one or more extensions that extend along an axis that is different from the trigger link axis A1 (FIG. 11). As shown, the trigger link 130 is formed as a single piece, however in other embodiments, the trigger link 130 may include multiple pieces.

Figure 13:
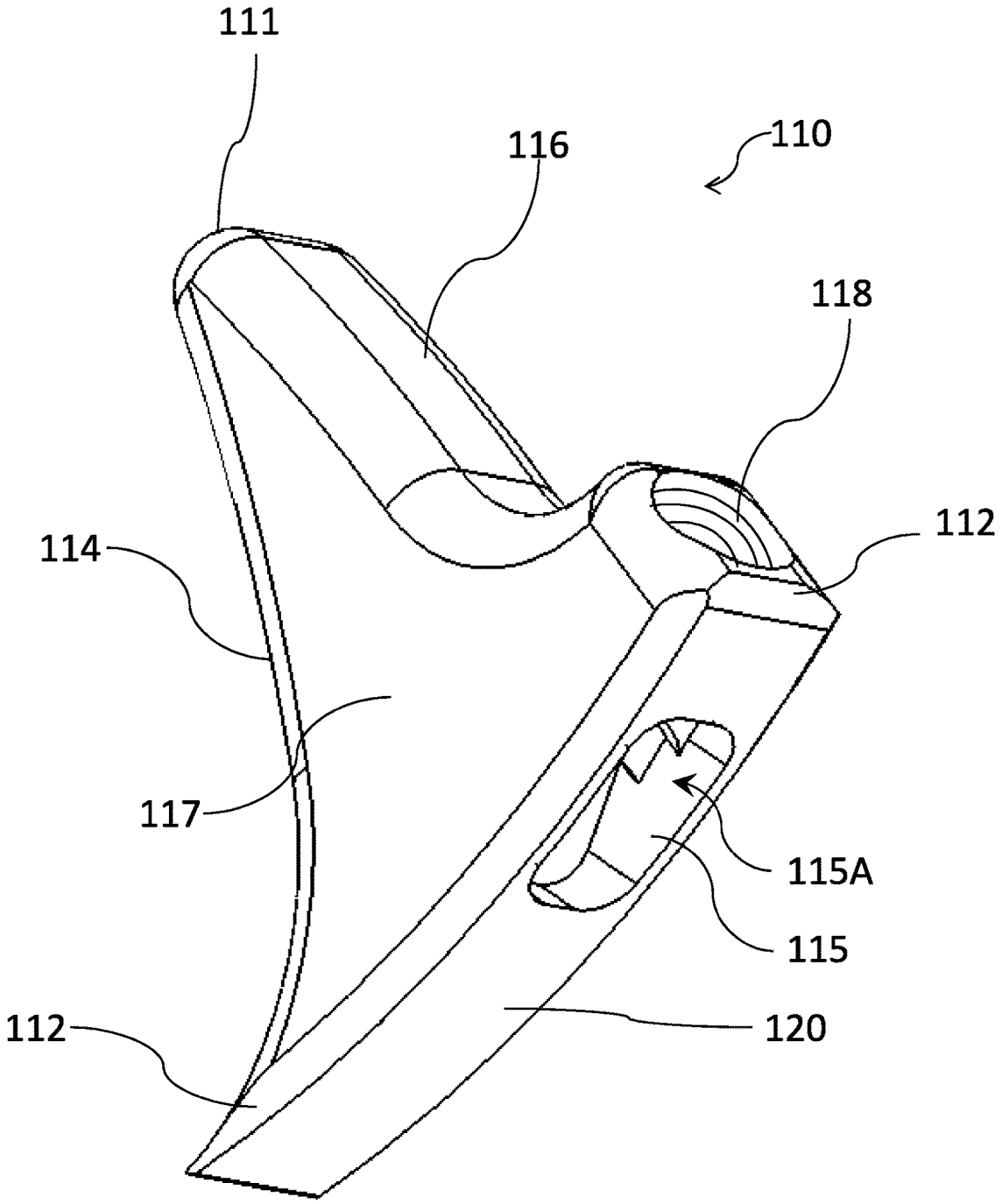
FIG. 13 is an enlarged isometric view of an embodiment of the trigger of the archery release device of FIG. 1.

Referring to FIG. 13, an embodiment of the trigger 110 may generally comprise a top 111 and a bottom 120. A grasp surface or actuation surface 114 is configured to accommodate and be engaged with one or more of an archer's fingers during actuation of the trigger 110. A safety or block surface 116 is generally positioned at an opposite end of the trigger 110 from the actuation surface 114 and is configured to be engaged with one or more of the user's fingers to enable the user to block or stop the actuation of the trigger 110. As shown, the trigger 110 further includes a base 112. Depending upon the embodiment, the base 112 can be spaced apart from the support 102, or the base 112 can be configured to slideably contact a portion of the support 102 of the release assembly 100, as illustrated in FIGS. 6-9. In an embodiment, part or all of the base 112 is positioned within the cavity 123, as shown in FIG. 7.

The bottom 120 defines a trigger link engagement portion 115 that is configured to receive and accept the trigger engagement surface 133 (FIG. 12B) of the trigger coupling portion 132 (FIG. 12B) so as to couple the trigger 110 to the trigger link 130 (FIG. 12B). In this embodiment, the trigger link engagement portion 115 defines a cavity 115A configured to receive the trigger engagement surface 133 (FIG. 12B).

Figure 9:
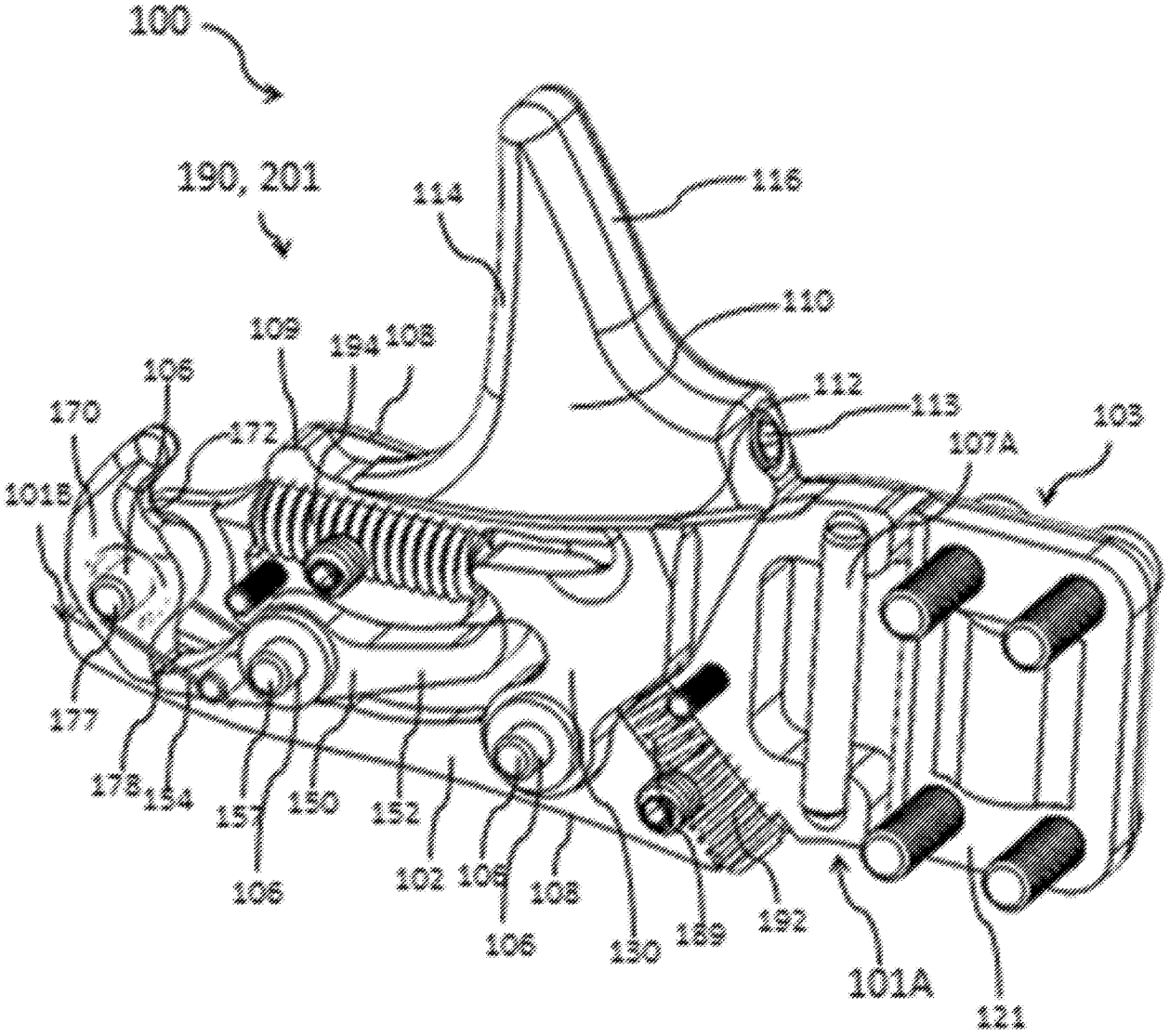
FIG. 9 is an enlarged, rear isometric view of the archery release device of FIG. 1, illustrating the elements visible when the top panel is removed.

Also, the trigger 110 has a trigger face 117 extending from the base 112 to the top 111 of the trigger 110. Only one trigger face 117 is shown in FIG. 13, however an opposing trigger face (not shown) is located on an opposite side from the trigger face 117. As shown in the embodiment of FIG. 13, the trigger face 117 is generally triangular in shape, however in other embodiments the trigger face 117 may have rectangular, square, oval or other shapes. The trigger 110 also defines a locking cavity or securement cavity 118 positioned between the base 112 and the block surface 116. The securement cavity 118 may define a plurality of threads configured to engage a trigger fastener 113 (FIG. 9). By screwing the trigger fastener 113 (FIG. 9) into the securement cavity 118, an archer can compress the trigger engagement surface 133 (FIG. 12B) against the trigger 110 to secure the trigger 110 to the trigger link 130 (FIG. 12B).

Figure 10:
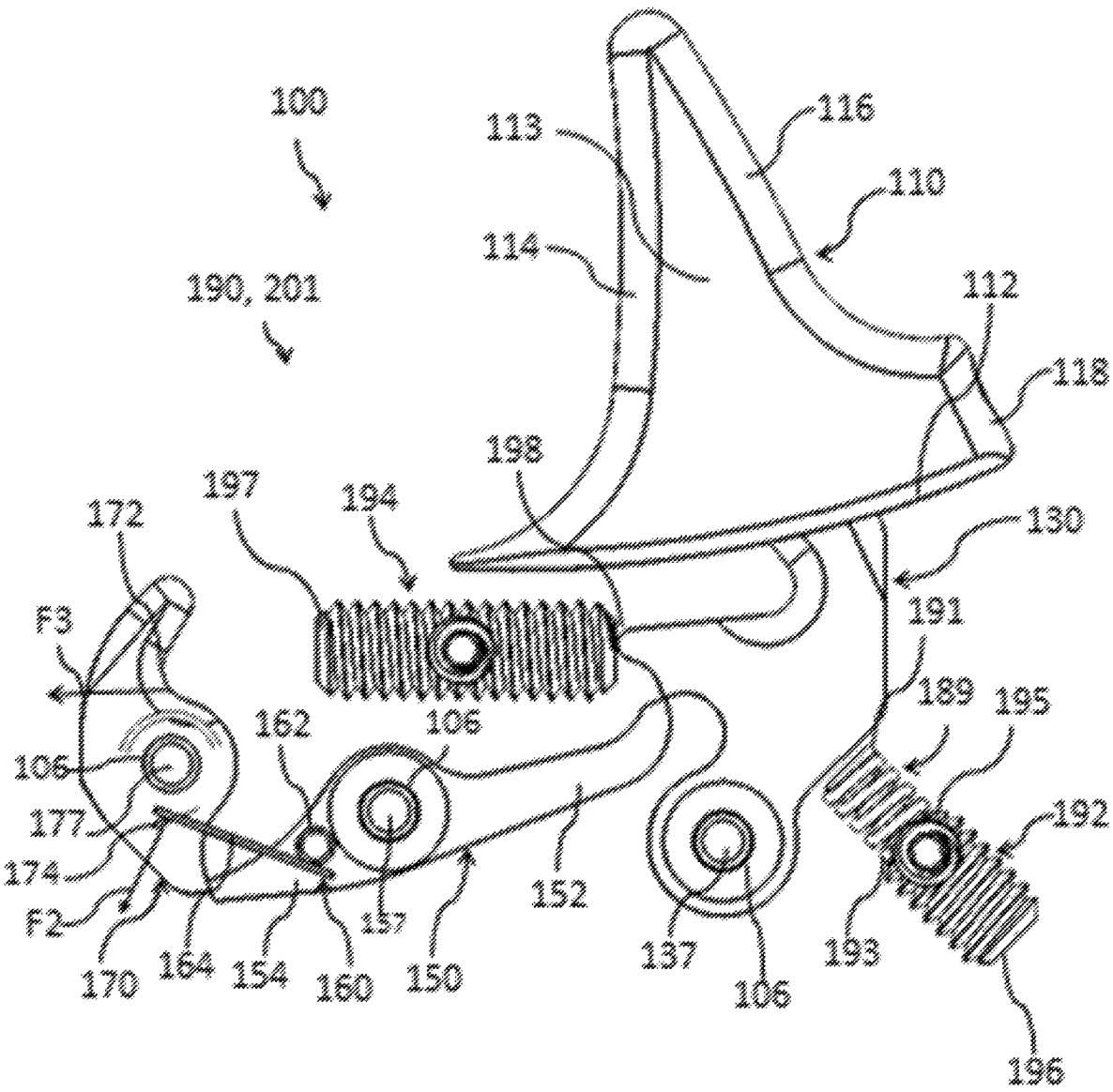
FIG. 10 is an enlarged side elevation view of the archery release device of FIG. 1, illustrating the elements visible when the support and the top panel are removed.
Figure 14A:
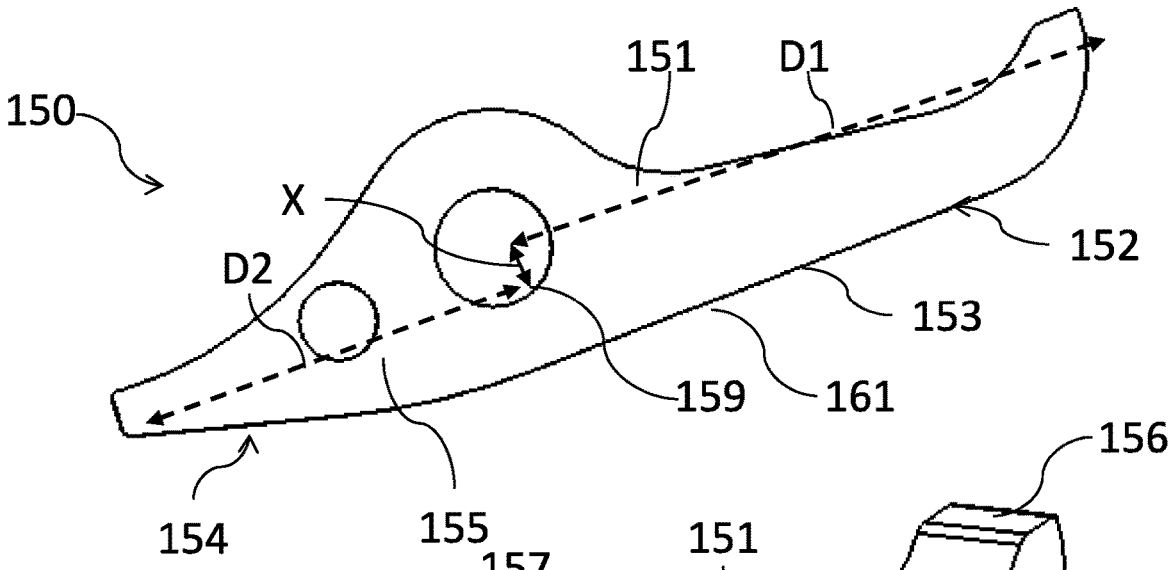
FIG. 14A is an enlarged side elevation view of an embodiment of the leverage link of the archery release device of FIG. 1.
Figure 14B:
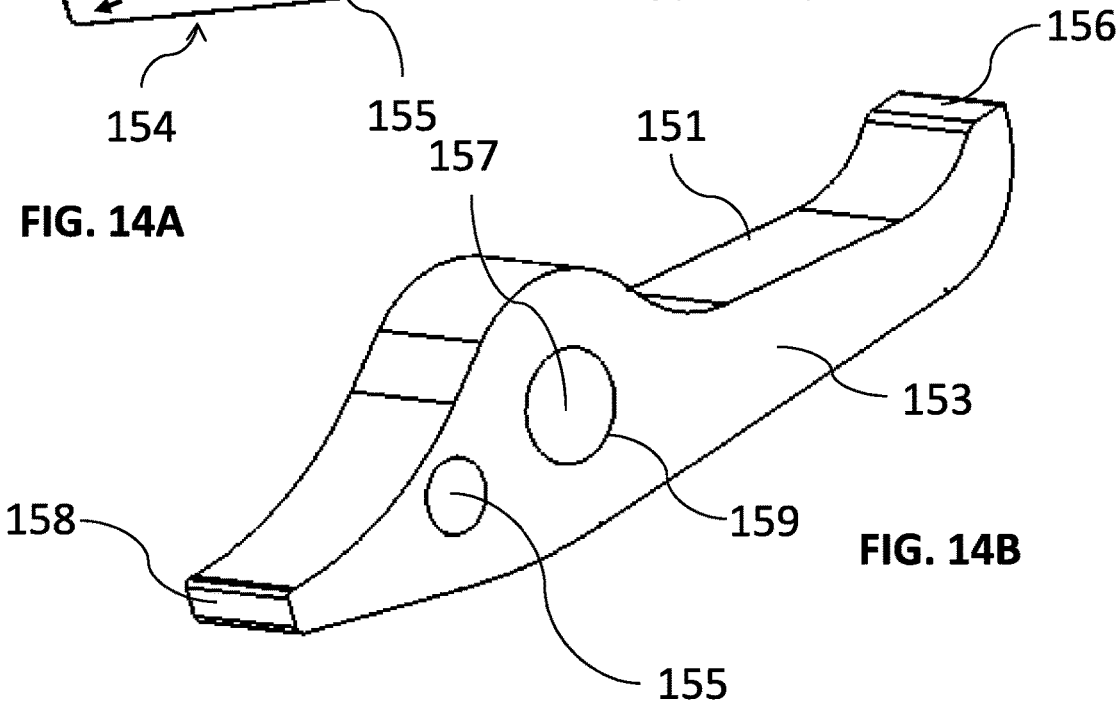
FIG. 14B is an enlarged, front isometric view of the leverage link of FIG. 14A.
Figure 14C:
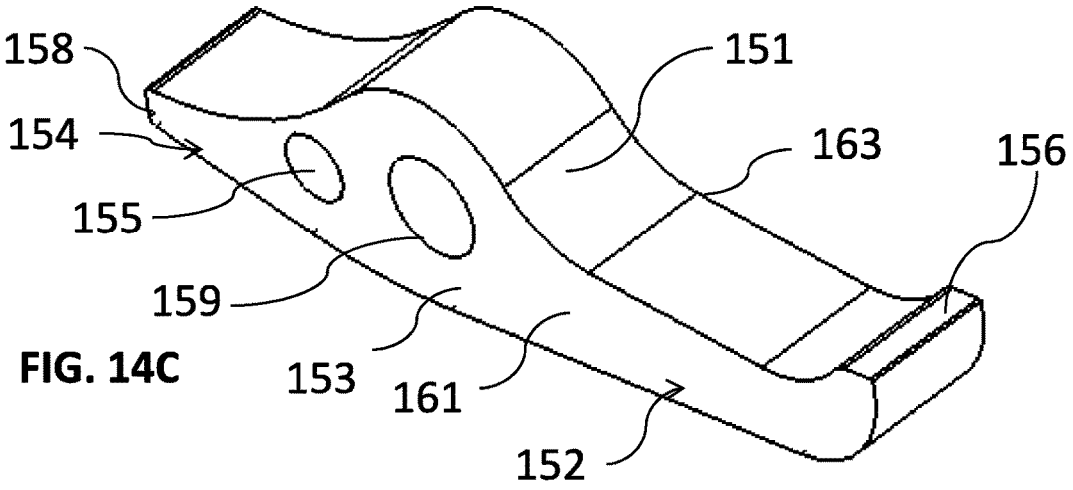
FIG. 14C is an enlarged, rear isometric view of the leverage link of FIG. 14A.
Figure 16:
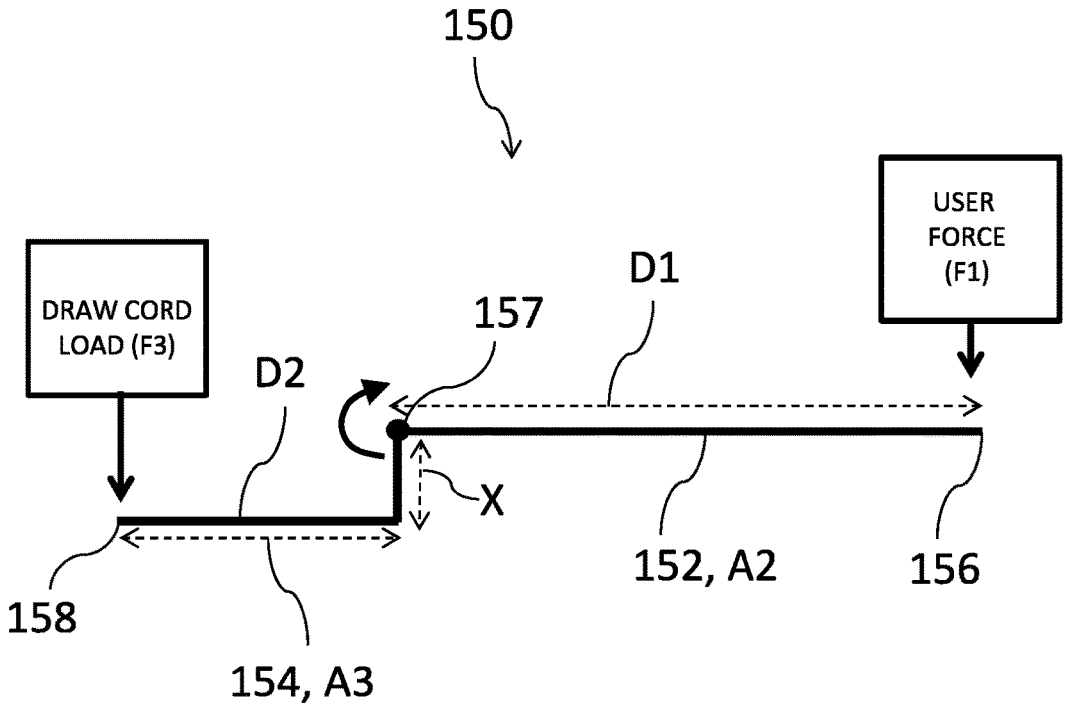
FIG. 16 is a schematic force diagram illustrating the distribution of forces and movement action of an embodiment of the leverage link of the archery release device of FIG. 1.

As illustrated in the embodiments of FIGS. 14A-14C, the leverage link 150 includes top surface 151, a bottom surface 153, a front surface 161, and a back surface 163. A bore 159 extends between the front and back surfaces 161, 163 and is configured to receive a support member 106 (FIGS. 10-11A). As shown in FIGS. 11A, 14A, and 16, the bore 159 is centered about or otherwise surrounds a fulcrum point 157. Functioning as a lever, the leverage link 150 is configured to pivot about the support member 106 that extends through the bore 159. Such support member 106, positioned at the fulcrum point 157, serves the role of a fulcrum for the leverage action of the leverage link 150. The leverage link 150 also includes a spring engagement portion 155 positioned on the front surface 161. Depending upon the embodiment, the spring engagement portion 155 can include a protrusion or define a recess configured for engagement with the torsion spring 160, as described below. The leverage link 150 also includes a first extension or first arm 152 and a second extension or second arm 154. In the example shown, the first arm 152 is longer than the second arm 154. In an embodiment, the first arm 152 is at least twice as long as the second arm 154. A first release interface 156 is positioned on the first arm 152 and is configured to engage the trigger release interface 138 (FIG. 12C) of the trigger link 130.

It should be understood that FIGS. 6-11A depict the release mechanism 190 in a hold arrangement 201. As described below, release mechanism 190 is operable to transition from: (a) the hold arrangement 201 for retaining or holding the draw cord 300; to (b) a release arrangement (not shown) for releasing the draw cord 300. Referring specifically to FIG. 11A, the hold arrangement 201 is achieved when the leverage link 150 is coupled to, and held by, the trigger link 130, which causes the cord holder 170 to retain or otherwise hold the draw cord 300, as described below.

As shown in FIGS. 11A, 14A, and 16, in the hold arrangement 201, the first arm 152 extends a distance D1 from the fulcrum point 157 to the first release interface 156 along a first arm axis A2. A second release interface 158 is positioned on the second arm 154. The second arm 154 extends a distance D2 from the fulcrum point 157 to the second release interface 158 along a second arm axis A3. As described in more detail below, the distance D1 along the first arm axis A2 is longer than the distance D2 along second arm axis A3. Also, the first arm axis A2 is offset from the second arm axis A3 by an offset distance X. This X offset provides important mechanical advantages and desirable instability, as described below. As shown in FIGS. 14A-14C, the leverage link 150 is formed as a single piece, however in other embodiments the leverage link 150 may be formed of multiple pieces.

Figure 15A:
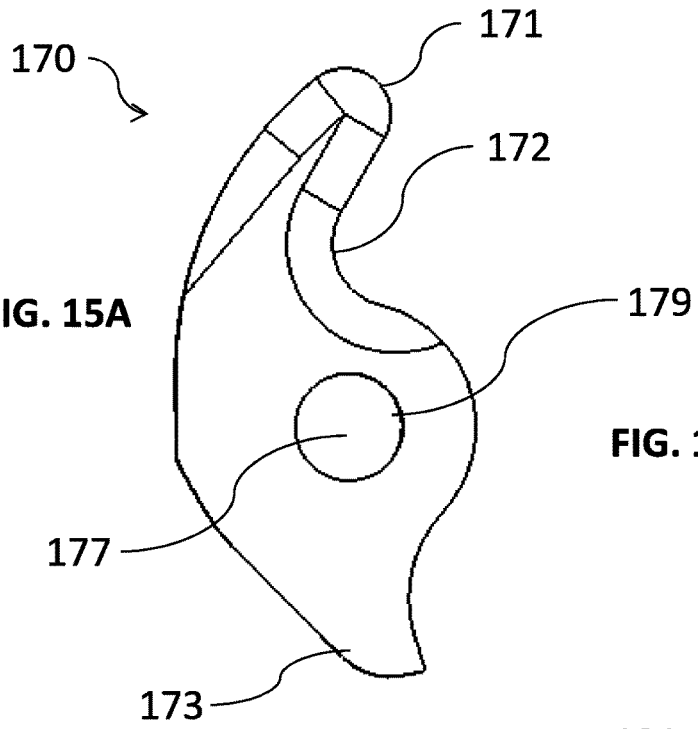
FIG. 15A is an enlarged side elevation view of an embodiment of the cord holder of the archery release device of FIG. 1.
Figure 15B:
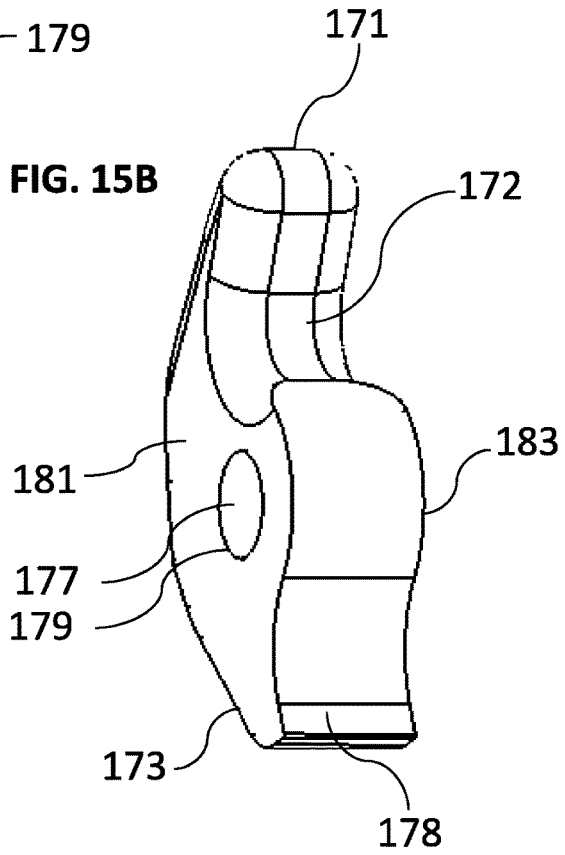
FIG. 15B is an enlarged, top isometric view of the cord holder of FIG. 15A.
Figure 15C:
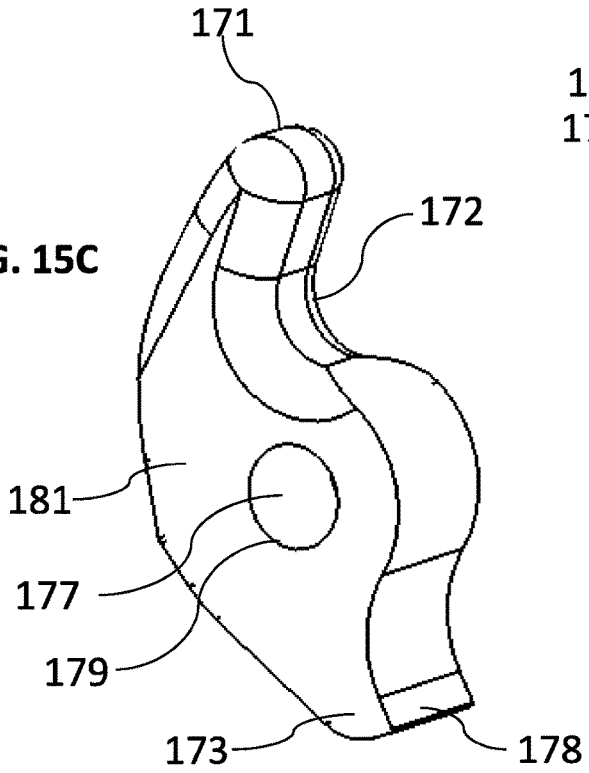
FIG. 15C is another enlarged, top isometric view of the cord holder of FIG. 15A.

Referring to the embodiments shown in FIGS. 15A-15C, the cord holder 170 includes a hook-shaped end or hook end 171 and a link engagement end 173. The hook end 171 includes a cord engager 172 configured to retain or hold a portion of a draw cord 300 (FIG. 11A) as it is drawn and loaded. The cord holder 170 further includes a front surface 181, a back surface 183 and a bore 179 that extends between the front and back surfaces 181, 183. The bore 179 is configured to receive a fastener or support member 106 (FIGS. 11A-11B), such as a post or pivot member. The bore 179 is centered about or otherwise surrounds a cord holder fulcrum point 177. Functioning as a lever, the cord holder 170 is configured to pivot about the support member 106 that extends through the bore 179. The link engagement end 173 includes a third release interface 178 configured to engage the second release interface 158 (FIGS. 14B-14C and FIG. 18) of the leverage link 150.

Referring back to FIG. 11A, the cord holder 170 extends along a first cord holder axis A4 from the link engagement end 173 to the cord holder fulcrum point 177. The first cord holder axis A4 and the second arm axis A3 intersect and an angle $\alpha$. Depending on the embodiment, the angle $\alpha$ can be ninety degrees, substantially ninety degrees, any angle within the range of seventy degrees to one hundred twenty degrees, or any other suitable angle. A second cord holder axis A5 extends from the cord holder fulcrum point 177 to the hook end 171. As shown, the cord holder 170 is formed as a single piece, however in other embodiments, the cord holder 170 may be formed of multiple pieces.

Referring back to FIGS. 9-10, the trigger link 130 is pivotally coupled to the support 102 at an end proximate the extension coupler 107A such that the trigger link 130 is configured to pivot about a trigger fulcrum point 137 (FIG. 12C). The bore 139 is centered about or otherwise surrounds the trigger fulcrum point 137. Functioning as a lever, the trigger link 130 is configured to pivot about the support member 106 that extends through the bore 139. A compression spring 189 is at least partially housed within the support 102 and has a first end 191 configured to contact the stop side 135 of the trigger link 130 and a second end 193 configured to contact or engage a spring adjuster 192. A trigger link adjuster 194 is at least partially housed within the support 102 and configured to contact the link engagement contact surface 140 of the trigger link 130 at a link engagement end 198. The leverage link 150 is pivotally coupled to the support 102 by a support member 106 such that the leverage link is configured to pivot about a fulcrum point 157. The cord holder 170 is also pivotally coupled to the support 102 by a support member 106 such that it is configured to pivot about the cord holder fulcrum point 177.

As shown in the embodiments illustrated in FIGS. 6-8 and 10, the release assembly 100 has a torsion spring 160. The torsion spring 160 has a coil 162 configured to engage the spring engagement portion 155 of the leverage link 150 and a spring arm 164 extending from the coil 162. As shown, the spring arm 164 extends from the coil 162 in a direction toward the cord holder 170. The spring arm 164 is configured to engage a spring arm engager 174 positioned on the cord holder 170. In the hold arrangement 201, the coil 162 is tensioned and applies a force F2 (FIG. 10) to the spring arm engager 174, which, in turn, imparts a force to the cord holder 170, which counteracts the force F3 (FIGS. 10-11A, and 16) exerted by the draw cord 300 (FIGS. 10-11A and 16). In an embodiment, the force F2 applies a constant biasing force to the cord holder 170 to predispose the cord holder 170 to be physically engaged with the leverage link 150, avoiding looseness between the cord holder 170 and the leverage link 150.

As shown in FIGS. 6-10, the compression spring 189 has a first end 191 that may contact a portion of the trigger link 130 and a second end that may engage a spring engagement end 195 of the spring adjuster 192. The spring adjuster 192 further includes an adjusting end 196 that is configured to allow the spring adjuster 192 to be further inserted within the support 102 or partially withdrawn from the support 102. In an embodiment, the spring adjuster 192 is a set screw having exterior threads configured to threadably engage with internal threads of the support 102. Rotation of the spring adjuster 192 can compress and decompress the compression spring 189 and thereby affect the resistance of the trigger 110 to actuation as well as the recovery of the trigger 110 and the components of the release assembly 100. In an embodiment, the compression spring 189 may not cause automatic recovery of the trigger 110 after actuation but may bias the trigger 110 toward the hold arrangement 201 (FIGS. 6-11A). This can reduce unintentional triggering of the archery release device 10.

Figure 17:
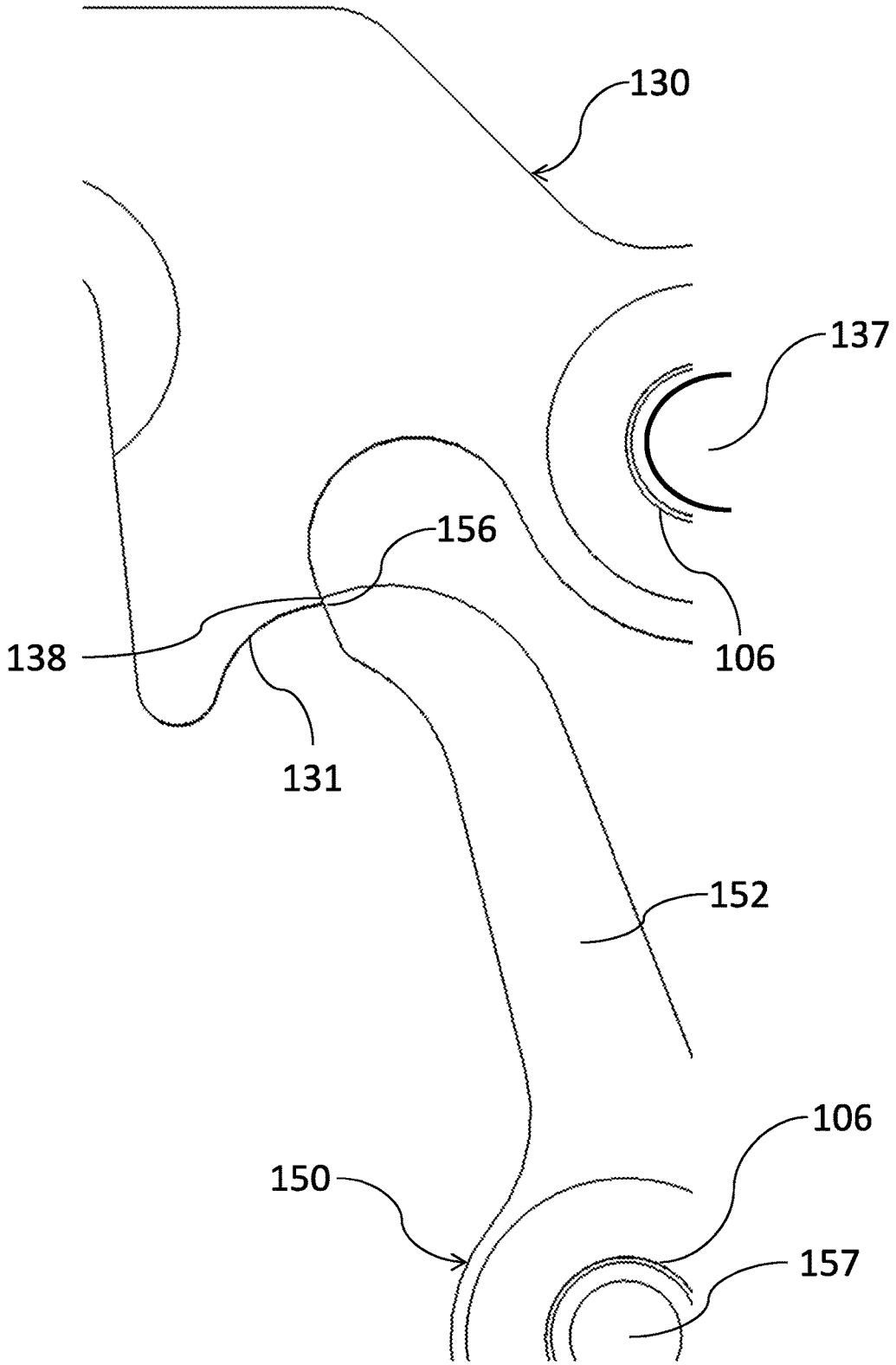
FIG. 17 is an enlarged, fragmentary side view of the trigger link engaged with the leverage link, illustrating the physical contact between the trigger release interface and the first release interface of the leverage link.
Figure 17A:
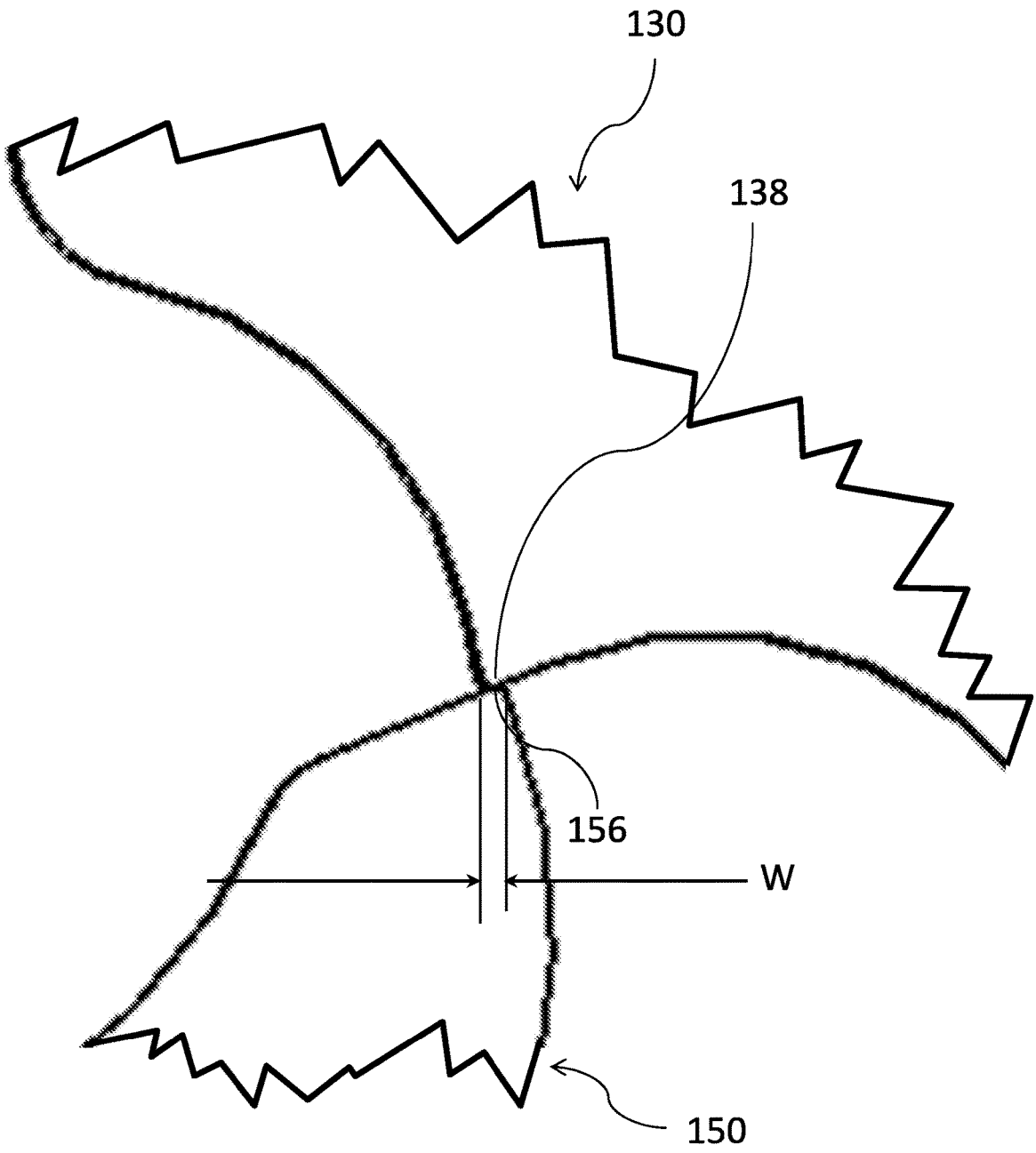
FIG. 17A is another enlarged, fragmentary side view of the trigger link engaged with the leverage link, illustrating the overlap between the trigger release interface and the first release interface of the leverage link.
Figure 17B:
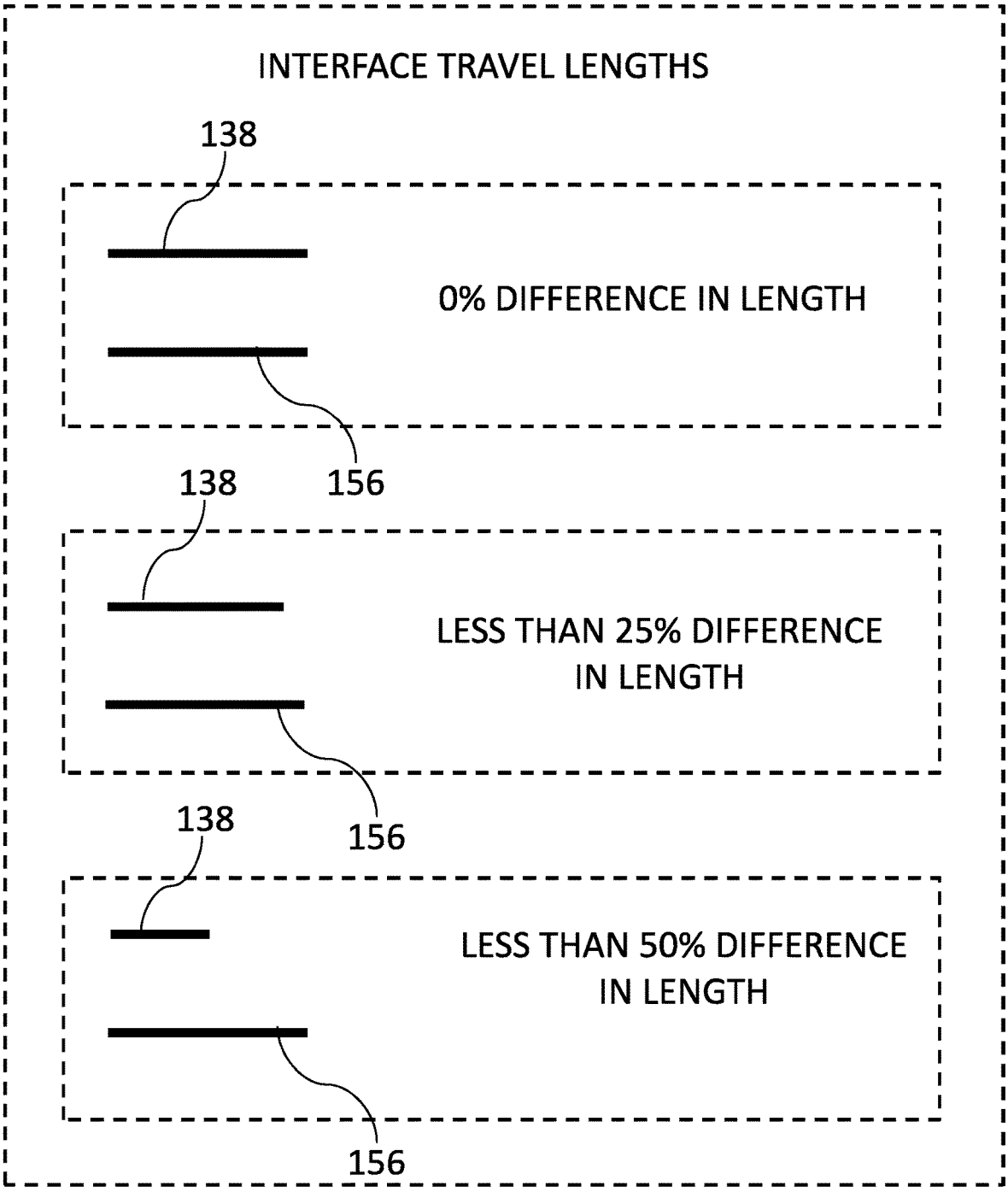
FIG. 17B is a schematic diagram illustrating a plurality of examples of different sets of travel lengths of the trigger release interface and the first release interface of the leverage link.

As illustrated in FIG. 10, a trigger link adjuster 194 is positioned below the actuation surface 114 of the trigger 110 and at least partially housed within the support 102. The trigger link adjuster 194 includes an adjusting end 197 configured to be adjusted to increase or decrease the force applied by a link engagement end 198 to the link engagement contact surface 140 of the trigger link 130. In an embodiment, the trigger link adjuster 194 is a set screw having exterior threads configured to threadably engage with internal threads of the support 102. Rotation of the trigger link adjuster 194 may allow the user to limit the pivotal freedom of the trigger link 130. By adjusting the the trigger link adjuster 194, the user can vary the extent of the overlap W (FIG. 17A) between the interface 138 (FIG. 12B) of the trigger link 130 and the first release interface 156 (FIG. 14B) of the leverage link 150, as illustrated in FIGS. 17-17A. A decrease in the overlap W results in an increase in the responsiveness or release sensitivity of the archery release device 10. This is because less time is spent between the user's pulling of the trigger 110 and the sliding apart of the interfaces 138, 156 (FIG. 17). In the embodiment illustrated in FIG. 17, the overlap W is a relatively small, edge-to-edge interface, which results in enhanced release responsiveness to the pulling of trigger 110. As shown in FIG. 17B, in an embodiment, each of the interfaces 138, 156 has a length. As the interfaces 138, 156 slide past each other, while in contact with each other, the sliding or traveling occurs along such lengths. In an embodiment, such lengths vary by zero percent. In another embodiment, such lengths vary by less than twenty-five percent. In yet another embodiment, such lengths vary by less than fifty percent. The relatively small variation in the lengths of interfaces 138, 156 results in enhanced release responsiveness to the pulling of trigger 110.

Figure 18:
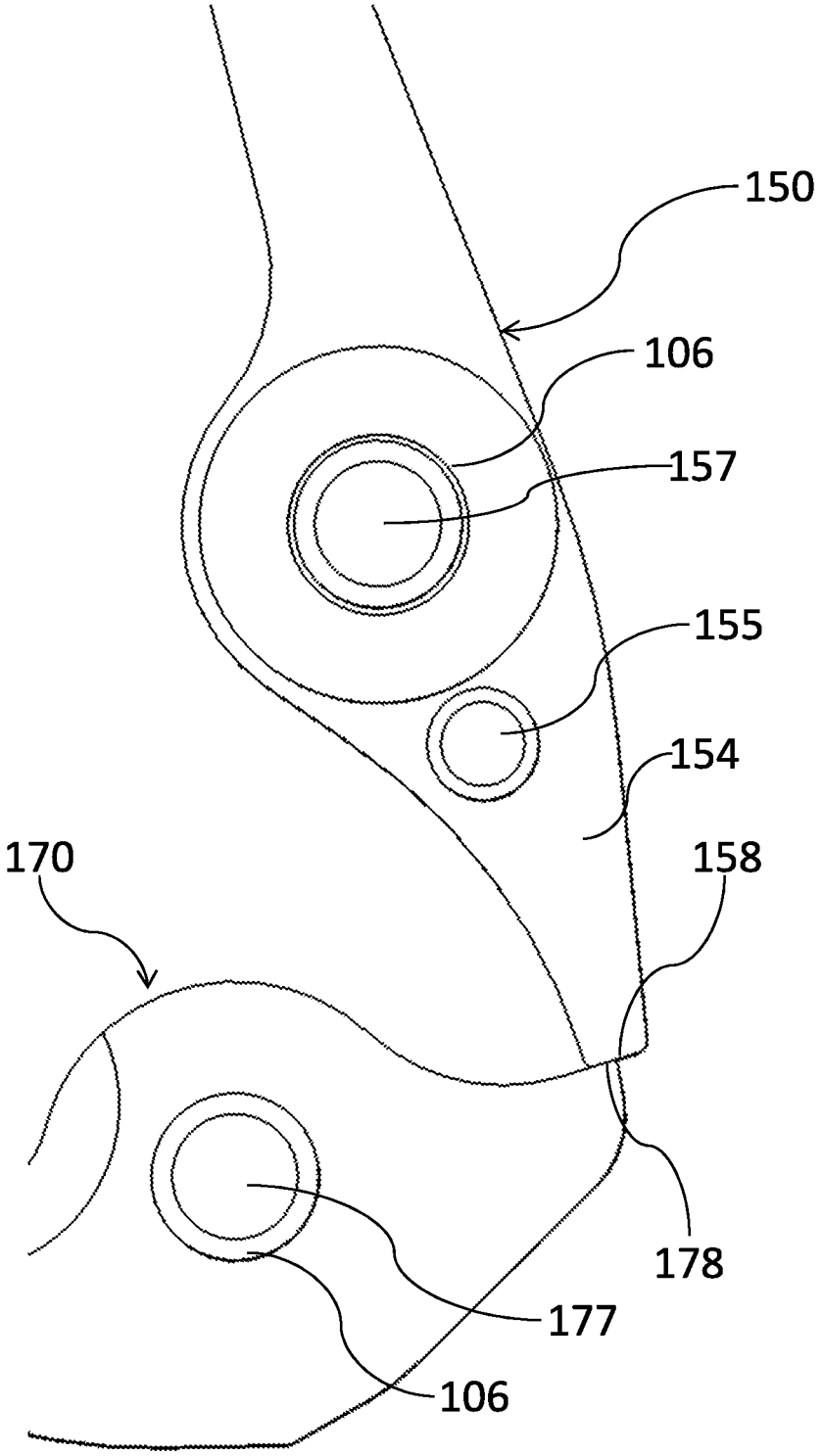
FIG. 18 is an enlarged, fragmentary side view of the cord holder engaged with the leverage link, illustrating the physical contract between the third release interface of the cord holder and the first release interface of the leverage link.

When the release assembly 100 is in the hold arrangement 201 (FIGS. 6-11A), the trigger release interface 138 of the trigger link 130 is in engagement or physical contact with the first release interface 156 of the first arm 152 (FIG. 17). At the same time, the second release interface 158 is in engagement or physical contact with the third release interface 178 of the cord holder 170 (FIG. 18). This hold arrangement 201 (FIGS. 6-11A) properly positions the cord holder 170 such that the cord engager 172 can grab and hold the draw cord 300 (FIGS. 3 and 11A).

When the user is ready to use the archery release device 10, the user maneuvers the trigger 110 and the cord holder 170 to position the archery release device 10 in the hold arrangement 201. Next, the user hooks the archery release device 10 onto the draw cord 300, and draws back the draw cord 300. When ready to fire, the user pulls or actuates the trigger 110 by applying a pulling force F1 (FIG. 11A) to the actuation surface 114 of the trigger 110. The force F1 (FIG. 11A) causes the trigger 110 to actuate in a direction r3 toward the extension support 103. Pulling or actuation of the trigger 110 causes the trigger link 130 to pivot in a clockwise direction about the trigger fulcrum point 137 causing the trigger release interface 138 to disengage or otherwise lose physical contact with the first release interface 156 of the leverage link 150, which decouples the trigger link 130 from the leverage link 150. After interfaces 138, 156 disengage or separate (not shown), the leverage link 150 then pivots in a counterclockwise direction about the fulcrum point 157 such that the first release interface 156 may slide into physical contact with the riding surface 131 of the trigger link 130. Also, the counterclockwise rotation of the leverage link 150 causes the second release interface 158 to lose physical contact with the third release interface 178 of the cord holder 170, which decouples the leverage link 150 from the cord holder 170. This loss in physical contact results in the cord holder 170 pivoting in a counterclockwise direction about the cord holder fulcrum point 177 causing the release of the draw cord 300 from the cord engager 172. At this point, the archery release device 10 has changed from the hold arrangement 201 FIGS. 6-11A) to a release arrangement (not shown), enabling the draw cord 300 (FIGS. 3 and 11A) to launch an arrow toward a target.

In order to return the release assembly 100 to the hold arrangement 201, the user can slide the trigger 110 (FIGS. 6-9) and manually pivot the cord holder 300. In one example, this movement enables the trigger link 130 to pivot in a counterclockwise direction toward the opposing end 101B (FIGS. 6-9) of the support 102 (FIGS. 6-9). The counterclockwise pivoting of the trigger link 130 may be restricted by the stop side 135 contacting the stop surface 105 (FIG. 8) of the support 102 (FIGS. 6-9). The spring 189 may aid the trigger link 130 and hence the trigger 110 in recovering to the hold arrangement 201. The spring 189 exerts a force on the stop side 135 of the trigger link 130 which causes it to pivot, or aids in its pivoting, about the trigger fulcrum point 137 in a counterclockwise direction. The counterclockwise pivoting of the trigger link 130 causes the first release interface 156 and/or a portion of the first arm 152 of the leverage link 150 to contact and move along the riding surface 131 until the trigger release interface 138 and the first release interface 156 are in physical contact with or engaged with each other. The link engagement end 198 of the trigger link adjuster 194 contacts the link engagement contact surface 140 of the trigger link 130 to restrain the counterclockwise pivoting of the trigger link 130 initiated by the spring 189.

As described above, in an embodiment, the surface areas or travel lengths of the trigger release interface 138 and the first release interface 156 are relatively small such that only a relatively small amount of clockwise pivoting is required by the trigger link 130 to move the trigger release interface 138 out of contact or out of engagement with the first release interface 156 and into the release arrangement (not shown). For example, as shown in FIG. 17A, the trigger release interface 138 has a relatively sharp edge or peak configured to physical contact the relatively narrow, rectangular area of the first release interface 156. As a result, the overlap W (FIG. 17A) is relatively small. Therefore, a relatively slight or minor slide-based travel of the trigger release interface 138 along the first release interface 156, results in disengagement of the interfaces 138, 156. This enhances the responsiveness and release sensitivity of the archery release device 10.

Likewise, as illustrated in FIG. 18, in an embodiment, the surface areas or travel lengths of the second release interface 158 and the third release interface 178 are relatively small such that only a relatively small amount of counterclockwise pivoting is required by the leverage link 150 to move the second release interface 158 out of contact or out of engagement with the third release interface 178 and into the release arrangement (not shown). Therefore, a relatively slight or minor slide-based travel of the second release interface 158 along the third release interface 178, results in disengagement of the interfaces 158, 176. This further enhances the responsiveness and release sensitivity of the archery release device 10.

Depending upon the embodiment, the leverage link 50 can be coupled to the trigger 110 through a direct connection or an indirect connection. In an indirect connection embodiment, the leverage link 50 is coupled to the trigger 110 through the trigger link 130, as described above. In another indirect connection embodiment, not shown, the trigger link 130 is replaced with a link member that has a different shape, size or geometry than the trigger link 130. In a direct connection embodiment, not shown, the archery release device 10 excludes the trigger link 130. In such embodiment, the leverage link 150 is directly coupled to the trigger 110 without any intermediary link members.

Referring to FIGS. 11A, 14A, and 16, there are several factors that affect the leverage or mechanical advantage of the archery release device 10, including the ratio D1/D2 and the ratio D1/X of leverage link 150. An increase in the D1/D2 ratio increases the leverage advantage to the user.

Also, an increase in the DUX ratio increases the leverage advantage to the user. The greater the length of D1 compared to X, the less force F1 is required by the archer to release the draw cord 300 (FIGS. 3 and 11A). This makes it easier for the archer to pull the trigger 110 to achieve the release arrangement. In other words, this increases the sensitivity of the release assembly 100. A more sensitive trigger 110 has the benefit of being more responsive with less movement of the archer's trigger finger. This enables the archer to fire with greater ease and control, resulting in improved shooting performance.

In an embodiment, the offset distance X (FIG. 16) causes an instability in the leverage link 150. This instability facilitates a relatively low contact pressure between the interfaces 138, 156 (FIG. 17A). As a result, this relatively low contact pressure enables the interfaces 138, 156 to remain engaged and secure until the occurrence of a relatively slight trigger pulling force. This can give the archer the sense or feeling of zero travel responsiveness.

Additional embodiments include any one of the embodiments described above, where one or more of its components, functionalities or structures is interchanged with, replaced by or augmented by one or more of the components, functionalities or structures of a different embodiment described above.

Various parts, components, and structural elements of the release device 10 can be combined into an integral or unitary, one-piece object, or such parts, components, and structural elements can be distinct, removable items that are attachable to each other through screws, bolts, pins and other suitable fasteners. For example, the support 102 can incorporate, and be unitary with, the extension support 103 and the support members 106.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery release device comprising:

a support;

a trigger moveably coupled to the support;

a leverage link pivotally coupled to the support, wherein the leverage link is configured to pivot about a fulcrum point, wherein the leverage link comprises first and second arms, wherein:

the first arm extends from the fulcrum point;

the first arm extends at least partially along a first arm axis;

the first arm comprises a first release interface located a lever distance from the fulcrum point;

the second arm extends in a direction opposite of the first arm;

the second arm extends at least partially along a second arm axis;

the second arm comprises a second release interface positioned on the second arm axis; and the second arm axis is offset from the first arm axis by an offset distance;

a cord holder pivotally coupled to the support, wherein the cord holder comprises:

a cord engager configured to hold an archery draw cord that is applying a pulling force to the cord engager; and a third release interface, wherein the leverage link and the cord holder are configured to cooperate with each other, in response to a movement of the trigger, to establish one of a hold arrangement and a release arrangement, wherein, in the hold arrangement, the trigger, the leverage link and the cord holder are operatively coupled together through one of a direct connection and an indirect connection to cause the cord holder to hold the archery draw cord when the cord holder is subject to the pulling force, wherein, in the release arrangement, the first release interface is operatively decoupled from the trigger, and the second release interface is operatively decoupled from the third release interface of the cord holder to cause the cord holder to release the archery draw cord when the cord holder is subject to the pulling force, wherein the hold arrangement is configured to transition to the release arrangement in response to a trigger force that is applied to the trigger, wherein the lever distance is greater than the offset distance to reduce a magnitude of the trigger force that is necessary to cause the transition.

2. The archery release device of claim 1, wherein the support comprises a body that defines a cavity, wherein the leverage link is positioned within the cavity.

3. The archery release device of claim 2, wherein a portion of the trigger is positioned within the cavity.

4. The archery release device of claim 1, comprising a trigger link pivotally coupled to the support, wherein the trigger link comprises a trigger release interface configured to be engaged with the first release interface.

5. The archery release device of claim 4, wherein, in the hold arrangement, the first release interface is engaged with the trigger release interface.

6. The archery release device of claim 4, wherein, in the release arrangement, the first release interface is disengaged from the trigger release interface, wherein the disengagement causes the first release interface to be operatively decoupled from the trigger.

7. The archery release device of claim 6, wherein the first release interface comprises a first travel length, and the trigger release interface comprises a second travel length, wherein the first and second travel lengths differ by less than fifty percent (50%).

8. The archery release device of claim 6, wherein the first release interface comprises a first travel length, and the trigger release interface comprises a second travel length, wherein the first and second travel lengths differ by less than twenty five percent (25%).

9. The archery release device of claim 4, comprising a trigger link adjuster that is at least partially positioned within a cavity defined by the support, wherein the trigger link adjuster is configured to contact the trigger link.

10. An archery release device comprising:

a support;

a trigger moveably coupled to the support;

a leverage link pivotally coupled to the support, wherein:

the leverage link is configured to pivot about a fulcrum point, the leverage link comprises first and second arms, each of which extends along an axis, the first arm comprises a first release interface located a lever distance from the fulcrum point;

the second arm comprises a second release interface; and the axes are offset by an offset distance; and a cord holder pivotally coupled to the support;

wherein the leverage link and the cord holder are configured to cooperate with each other, in response to a movement of the trigger, to establish one of a hold arrangement and a release arrangement, wherein, in the hold arrangement, the trigger, the leverage link and the cord holder are operatively coupled together through one of a direct connection and an indirect connection to cause the cord holder to hold a draw cord when the cord holder is subject to a pulling force, wherein, in the release arrangement, the first release interface is operatively decoupled from the trigger, and the second release interface is operatively decoupled from the cord holder.

11. The archery release device of claim 10, wherein the support comprises a body that defines a cavity, wherein the leverage link is positioned within the cavity.

12. The archery release device of claim 10, wherein the first and second arms extend in opposite directions.

13. The archery release device of claim 10, comprising a trigger link pivotally coupled to the support, wherein the trigger link comprises a trigger release interface configured to be engaged with the first release interface.

14. The archery release device of claim 13, wherein, in the hold arrangement, the first release interface is engaged with the trigger release interface.

15. The archery release device of claim 14, wherein, in the release arrangement, the first release interface is disengaged from the trigger release interface, wherein the disengagement causes the first release interface to be operatively decoupled from the trigger.

16. The archery release device of claim 15, wherein the first release interface comprises a first travel length, and the trigger release interface comprises a second travel length, wherein the first and second travel lengths differ by less than twenty five percent (25%).

17. The archery release device of claim 13, comprising a trigger link adjuster that is at least partially positioned within a cavity defined by the support, wherein the trigger link adjuster is configured to contact the trigger link.

18. A method for manufacturing an archery release device, the method comprising:

obtaining a support;

coupling a trigger to the support so that the trigger is moveable relative to the support;

structuring a leverage link to comprise first and second arms, each of which extends along an axis, wherein:

the first arm comprises a first release interface located a lever distance from a fulcrum point;

the second arm comprises a second release interface; and the axes are offset by an offset distance; and coupling the leverage link to the support so that the leverage link is pivotal relative to the support so that the pivoting occurs about the fulcrum point;

coupling a cord holder to the support so that the cord holder is pivotal relative to the support; and arranging the leverage link and the cord holder to cooperate with each other, in response to a movement of the trigger, to establish one of a hold arrangement and a release arrangement, wherein, in the hold arrangement, the trigger, the leverage link and the cord holder are operatively coupled together through one of a direct connection and an indirect connection to cause the cord holder to hold a draw cord when the cord holder is subject to a pulling force, wherein, in the release arrangement, the first release interface is operatively decoupled from the trigger, and the second release interface is operatively decoupled from the cord holder.

19. The method of claim 18, comprising configuring the support to define a cavity, wherein the leverage link is positioned within the cavity.

20. The method of claim 18, comprising:

configuring a trigger link to comprise a trigger release interface configured to be coupled to the first release interface; and coupling the trigger link to the support so that the trigger link is pivotal relative to the support, wherein, in the hold arrangement, the first release interface is engaged with the trigger release interface, wherein, in the release arrangement, the first release interface is disengaged from the trigger release interface, wherein the disengagement causes the first release interface to be operatively decoupled from the trigger.

* * * * *